US006507254B1

(12) United States Patent
Hattori et al.

(10) Patent No.: US 6,507,254 B1
(45) Date of Patent: Jan. 14, 2003

(54) MULTIMODAL DIELECTRIC RESONANCE DEVICE, DIELECTRIC FILTER, COMPOSITE DIELECTRIC FILTER, SYNTHESIZER, DISTRIBUTOR, AND COMMUNICATION APPARATUS

(75) Inventors: Jun Hattori, Takatsuki (JP); Norihiro Tanaka, Nagaokakyo (JP); Shin Abe, Muko (JP); Toru Kurisu, Omihachiman (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/486,871

(22) PCT Filed: Aug. 28, 1998

(86) PCT No.: PCT/JP98/03831

§ 371 (c)(1),
(2), (4) Date: Jun. 5, 2000

(87) PCT Pub. No.: WO99/12225

PCT Pub. Date: Mar. 11, 1999

(30) Foreign Application Priority Data

Sep. 4, 1997 (JP) ..... 9-239686
Aug. 4, 1998 (JP) ..... 10-220372

(51) Int. Cl.[7] ..... H01P 1/20; H01P 5/12; H01P 7/04; H01P 7/10

(52) U.S. Cl. ..... 333/202; 333/206; 333/134; 333/222; 333/219.1

(58) Field of Search ..... 333/202, 206, 333/134, 222, 219.1

(56) References Cited

U.S. PATENT DOCUMENTS 4,271,399 A 6/1981 Morita ..... 333/219
4,623,857 A * 11/1986 Nishikawa et al. ..... 333/219
4,727,338 A 2/1988 Mamodaly et al. ..... 331/96
4,802,234 A 1/1989 Tatomir et al. ..... 333/211
4,879,533 A * 11/1989 de Muro et al. ..... 333/206
5,841,330 A * 11/1998 Wenzel et al. ..... 333/202
5,898,349 A * 4/1999 Hattori et al. ..... 333/202

FOREIGN PATENT DOCUMENTS

| | | |
|---|---|---|
| EP | 0064799 | 11/1982 |
| EP | 0336675 | 10/1989 |
| EP | 0647975 B1 | 5/2000 |
| JP | 61-277205 | 12/1986 |
| JP | 5-63414 | 3/1993 |
| JP | 7-58516 | 3/1995 |
| JP | 7-193405 | 7/1995 |
| JP | 8-78903 | 3/1996 |
| JP | 9-148810 | 6/1997 |

OTHER PUBLICATIONS

Canadian Office Action dated Feb. 28, 2002.
PCT: WO 98 253 21 A (Filtronic Ltd; Hunter Ian Charles) Jun. 11, 1998.
Article: Mongia R K: "Theoretical and Experimental Resonant Frequencies of Rectangular Dielectric Resonators" IEE Proceedings H. Microwaves, Antennas & Propagation, Institution O Electrical Engineers, Stevenage, vol. 139, No. 1 Part H, Feb. 1, 1992.

* cited by examiner

*Primary Examiner*—Patricia Nguyen
(74) *Attorney, Agent, or Firm*—Dickstein, Shapiro, Morin & Oshinsky, LLP.

(57) ABSTRACT

A multimode dielectric resonator device is provided in which a dielectric core can be easily disposed in a cavity, a dielectric resonator device comprising resonators in plural stages can be obtained, and the $Q_0$ is maintained at a high value. Dielectric cores 1*b*, 1*c* to resonate in plural modes such as TM01 δ-(x-z), TE01δ-y, TM01δ-(x+z) or the like are supported substantially in the center of a cavity 2 by means of a support 3, in the state that the cores are substantially separated from the inner walls of the cavity 2 at a predetermined interval, respectively.

15 Claims, 31 Drawing Sheets

TE01 δ-z

TE01 δ-x

TE01 δ-y

TM01 δ-z

TE01 δ-x

TM01 δ-y

TE01 δ-x

TE01 δ-y

TE01 δ-x

TM01 δ-y (TM01 δ)

(TE01 δ)

MULTIMODAL DIELECTRIC RESONANCE DEVICE, DIELECTRIC FILTER, COMPOSITE DIELECTRIC FILTER, SYNTHESIZER, DISTRIBUTOR, AND COMMUNICATION APPARATUS

TECHNICAL FIELD

The present invention relate to an electronic component, and more particularly to a dielectric resonator device, a dielectric filter, a composite dielectric filter, a synthesizer, a distributor, and a communication device including the same, each of which operates in a multimode.

BACKGROUND ART

A dielectric resonator in which an electromagnetic wave in a dielectric is repeatedly totally-reflected from the boundary between the dielectric and air to be returned to its original position in phase, whereby resonance occurs is used as a resonator small in size, having a high unloaded Q ($Q_0$). As the mode of the dielectric resonator, a TE mode and a TM mode are known, which are obtained when a dielectric rod with a circular or rectangular cross section is cut to a length of $s \cdot \lambda g/2$ ($\lambda g$ represents a guide wavelength, and s is an integer) of the TE mode or the TM mode propagating in the dielectric rod. When the mode of the cross section is a TM01 mode and the above-described s=1, a TM01δ mode resonator is obtained. When the mode of the cross section is a TE01 mode and s=1, a TE01δ mode dielectric resonator is obtained.

In these dielectric resonators, a columnar TM01δ mode dielectric core or a TE01δ mode dielectric core are arranged in a circular waveguide or rectangular waveguide as a cavity which interrupts the resonance frequency of the dielectric resonator, as shown in FIG. 27.

FIG. 28 illustrates the electromagnetic field distributions of the above-described two modes in the dielectric resonators. Hereupon, a continuous line represents an electric field, and a broken line a magnetic field, respectively.

In the case where a dielectric resonator device having plural stages is formed of dielectric resonators including such dielectric cores, the plural dielectric cores are arranged in a cavity. In the example shown in FIG. 27, the TM01δ mode dielectric cores shown in (A) are arranged in the axial direction, or the TE01δ mode dielectric cores shown in (B) are arranged along the same planed However, in such a conventional dielectric resonator device, to provide resonators in multi-stages, it is needed to position and fix plural dielectric cores at a high precision. Accordingly, there has been the problem that it is difficult to obtain dielectric resonator devices having characteristics with no variations.

Further, conventionally, TM mode dielectric resonators each having a columnar or cross-shaped dielectric core integrally provided in a cavity have been used. In a dielectric resonator device of this type, the TM modes can be multiplexed in a definite space, and therefore, a miniature, multistage dielectric resonator device can be obtained. However, the concentration of an electromagnetic field energy onto the magnetic cores is low, and a real current flows through a conductor film formed on the cavity. Accordingly, there have been the problem that generally, a high Qo comparable to that of the TE mode dielectric resonator can not be attained.

DISCLOSURE OF INVENTION

It is an object of the present invention to provide a multi-mode dielectric resonator device in which dielectric cores can be easily arranged in a cavity, a dielectric resonator device comprising resonators in plural stages can be obtained, and the $Q_0$ is maintained at a high value.

Moreover, it is another object of the present invention to provide a dielectric filter, a composite dielectric filter, a synthesizer, a distributor, and a communication device, each including the above-described multimode dielectric resonator.

In the multimode dielectric resonator device of the present invention, as defined in claim 1, a dielectric core having a substantial parallelepiped-shape, operative to resonate in plural modes is supported substantially in the center of a cavity having a substantial parallelepiped-shape in the state that the dielectric core is separated from the inner walls of the cavity at predetermined intervals, respectively. Since the substantial parallelepiped-shape dielectric core is supported substantially in the center of the cavity having a substantial parallelepiped-shape, as described above, the supporting structure for the dielectric core is simplified. Moreover, since the dielectric core having a substantial parallelepiped-shape, operative to resonate in plural modes is employed, plural resonators can be formed without plural dielectric cores being arranged. A dielectric resonator device having stable characteristics can be formed.

For supporting the dielectric core in the cavity, a support having a lower dielectric constant than the dielectric core is used, as defined in claim 2. Thereby, the concentration of an electromagnetic field energy to the dielectric core is enhanced, and the $Q_0$ can be maintained at a high value.

A supporting portion for the dielectric-core in the cavity may be molded integrally with the dielectric core or cavity, as defined in claim 3. Thereby, the support as an individual part becomes unnecessary. The positional accuracy of the supporting portion with respect the cavity or dielectric core, and moreover, the positioning accuracy of the dielectric core in the cavity are enhanced. Accordingly, a multimode dielectric resonator device having stable characteristics can be inexpensively obtained.

The supporting portion or support, as defined in claim 4, is provided in a ridge portion of the dielectric core or in a portion along a ridge line of the dielectric core, or is provided near to an apex of the dielectric core, as defined in claim 5. Thereby, the mechanical strength of the supporting portion per the overall cross sectional area thereof can be enhanced. Further, in the TM modes, the reduction of the $Q_0$ of the mode where the supporting portion or support is elongated in the vertical direction to the rotation plane of a magnetic field can be inhibited.

The supporting portion or support, as defined in claim 6, is provided in the center of one face of the dielectric core. Thereby, the reduction of the $Q_0$ of a mode different from the TM mode where the supporting portion or support is elongated in the vertical direction to the rotation plane of the magnetic field can be inhibited.

As defined in claim 7, a part of or the whole of the cavity is an angular pipe-shape molded-product, and the dielectric core is supported to the inner walls of the molded product by means of the support or supporting portion. According to this structure, by setting the mold-drafting direction to be coincident with the axial direction of the angular pipe-shape, the cavity and the dielectric core can be easily molded by means of a mold having a simple structure.

Also, according to this invention, formed is a dielectric filter by providing an externally coupling means to couple to a predetermined mode of the multimode dielectric resonator device.

Further, according to this invention, formed is a composite dielectric filter having at least three ports by use of plural above-described dielectric filters.

Further, according to this invention, formed is a synthesizer comprising independently, externally coupling means to couple to plural predetermined modes of the multimode dielectric resonator device, externally, independently, and a commonly externally coupling means to couple to plural predetermined modes of the multimode dielectric resonator device externally commonly, wherein the commonly externally coupling means is an output port, and the plural independently externally coupling means are input ports.

Further, according to this invention, formed is a distributor comprising independently, externally coupling means to couple to predetermined modes of the multimode dielectric resonator device, respectively, independently, and a commonly externally coupling means to couple to plural predetermined modes of the multimode dielectric resonator device commonly, externally, wherein the commonly externally coupling means is an input port, and the plural independently externally coupling means are output ports.

Moreover, according to the present invention, a communication device is formed of the composite dielectric filter, the synthesizer, or the distributor each described above, provided in the high frequency section thereof.

BEST MODE FOR CARRYING OUT THE INVENTION

The configuration of a multimode dielectric resonator device according to a first embodiment Will be described with reference to FIGS. 1 to 16.

Figure 1:
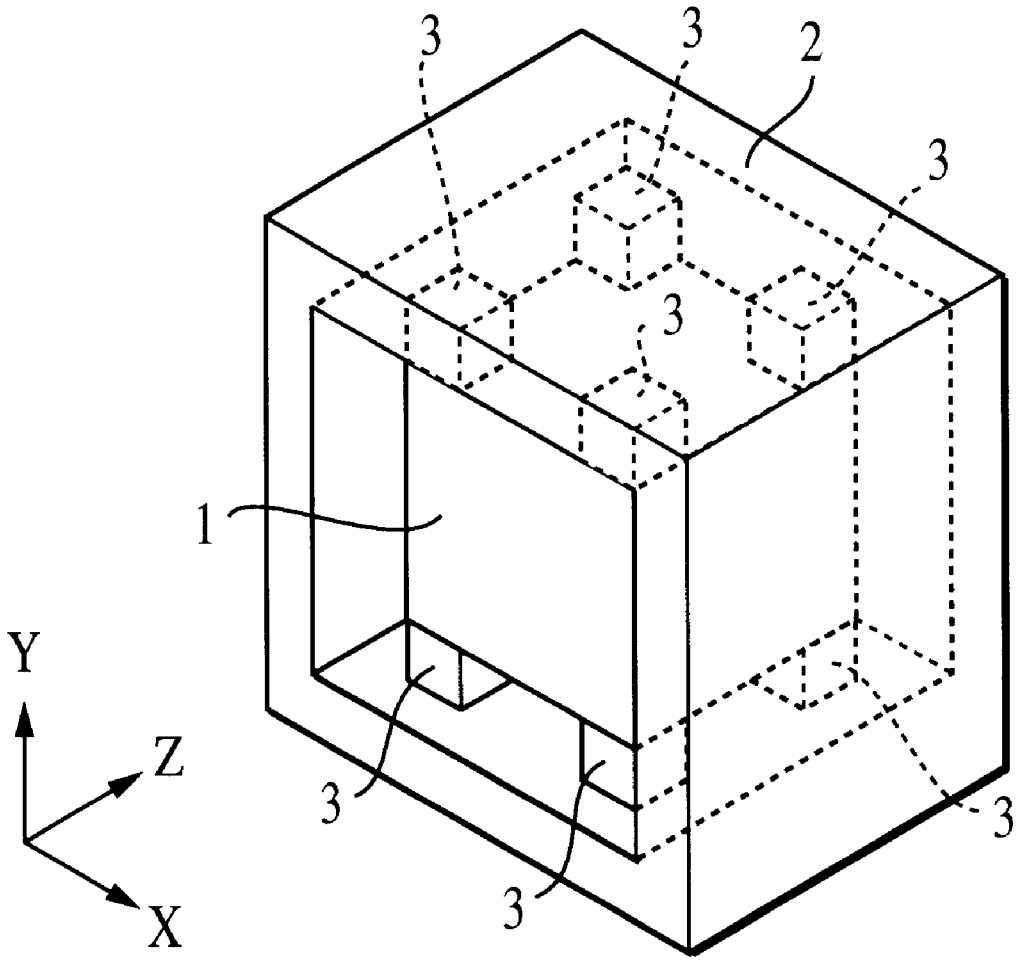
FIG. 1 is a perspective view showing the constitution of the basic portion of a multimode dielectric resonator device according to a first embodiment.

FIG. 1 is a perspective view showing the basic constitution portion of the multimode dielectric resonator device. In this figure, reference numerals 1, 2, and 3 designate a substantially parallelepiped-shaped dielectric core, an angular pipe-shaped cavity, and supports for supporting the dielectric core 1 substantially in the center of the cavity 2, respectively. A conductor film is formed on the outer peripheral surface of the cavity 2. On the two open-faces, dielectric plates or metal plates each having a conductor film are disposed, respectively, so that a substantially parallelepiped-shaped shield space is formed. In addition, an open-face of the cavity 2 is opposed to an open-face of another cavity so that electromagnetic fields in predetermined resonance modes are coupled to provide a multistage.

The supports 3 shown in FIG. 1, made of a ceramic material having a lower dielectric constant than the dielectric core 1 are disposed between the dielectric core 1 and the inner walls of the cavity 2 and fired to be integrated. The dielectric core may be disposed in a metallic case, not using such a ceramic cavity as shown in FIG. 1.

Figure 2A:
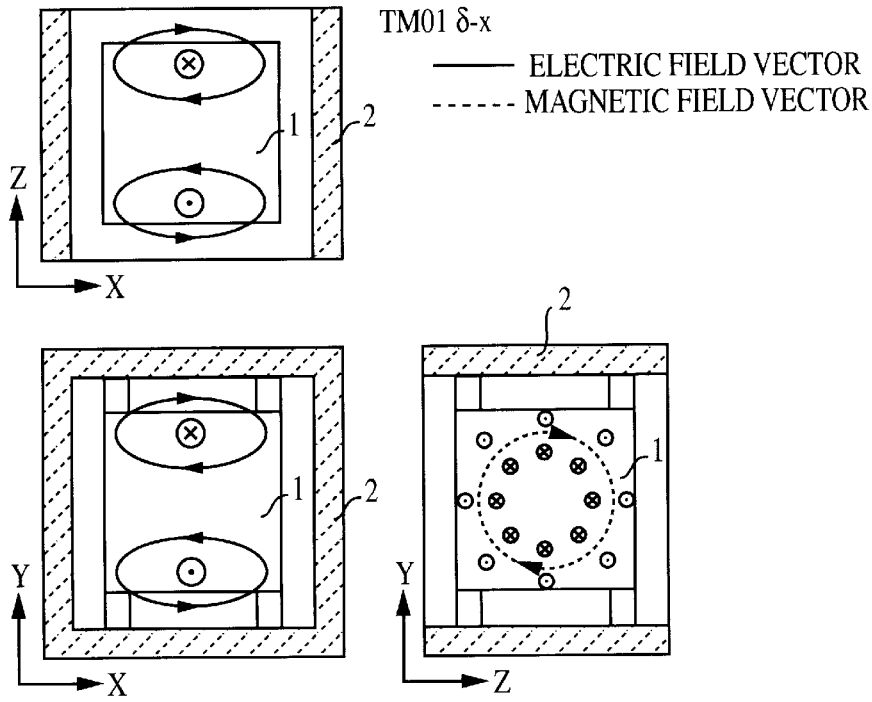
FIG. 2 consists of cross sections showing the electromagnetic field distributions in the respective modes of the above resonator device.
Figure 2B:
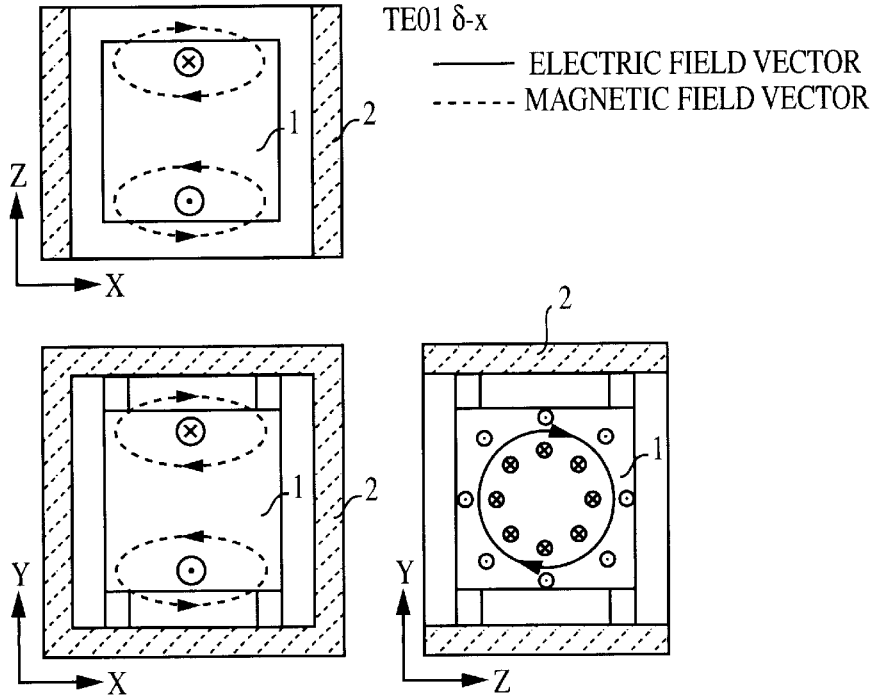
Figure 3A:
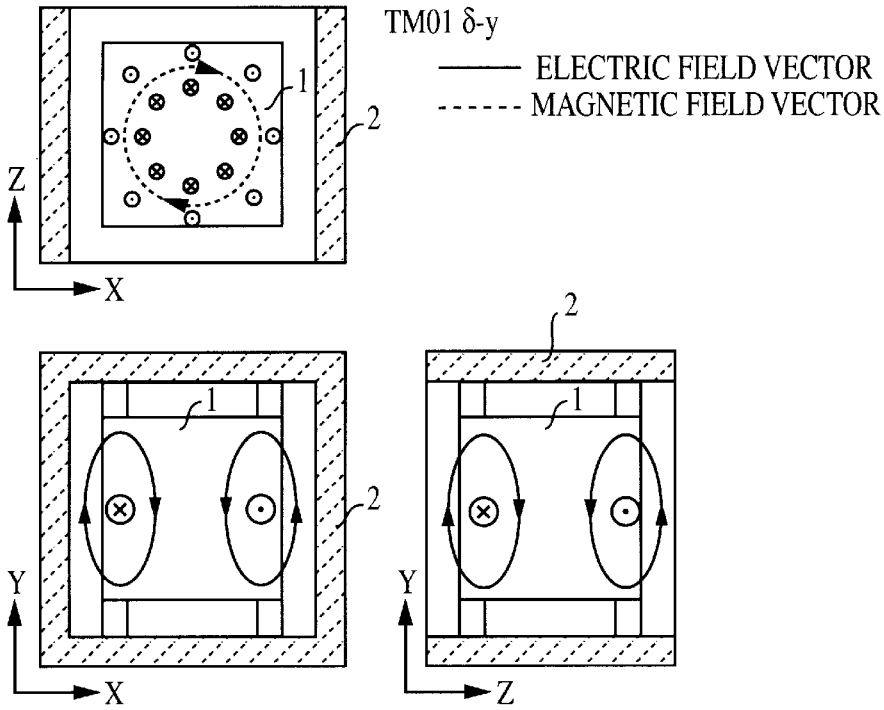
FIG. 3 consists of cross sections showing the electromagnetic field distributions in the respective modes of the above resonator device.
Figure 3B:
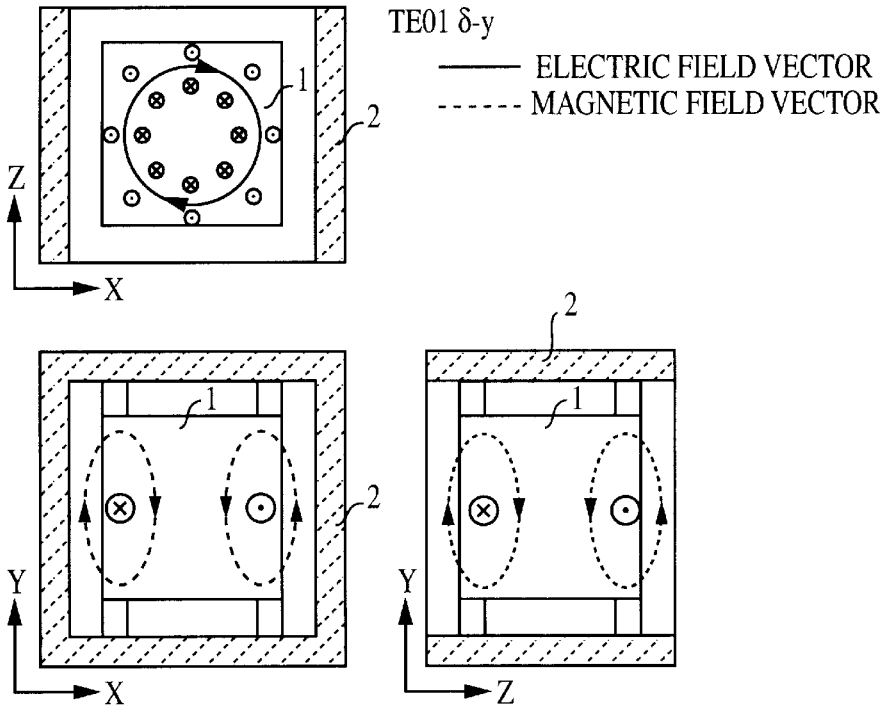
Figure 4A:
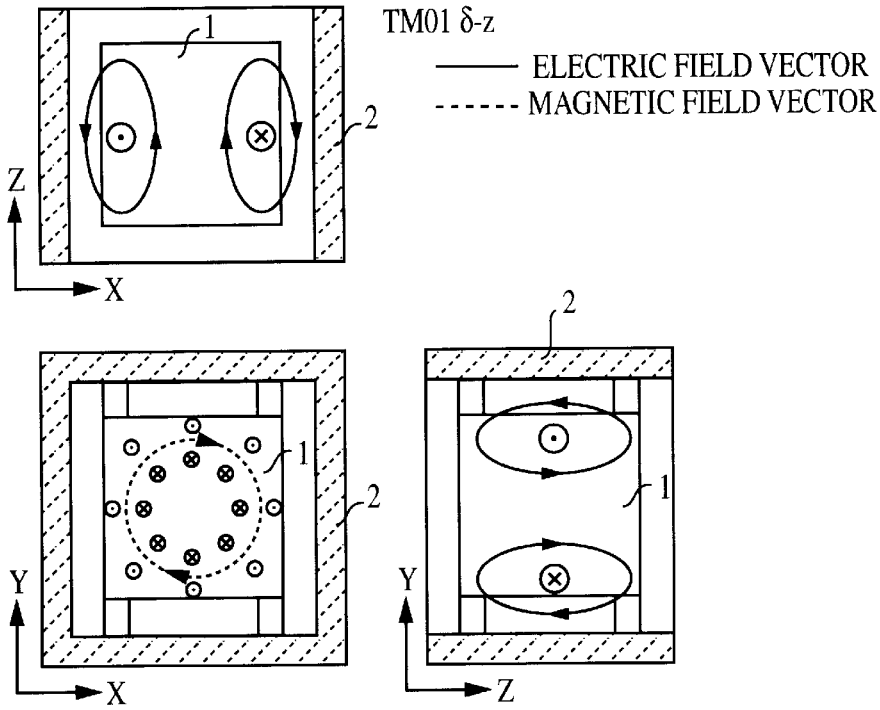
FIG. 4 consists of cross sections showing the, electromagnetic field distributions in the respective modes of the above resonator device.
Figure 4B:
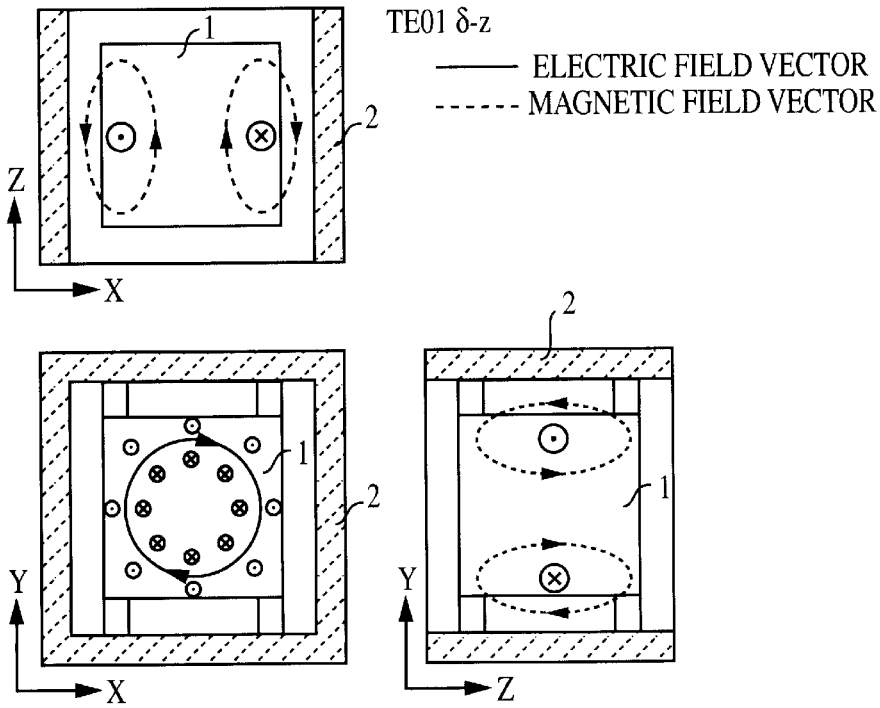
Figure 5A:
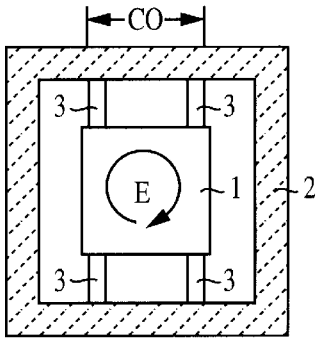
FIG. 5 illustrates the changes of the characteristics in the respective modes of the above resonator device, occurring when the intervals between the supports are changed.
Figure 5B:
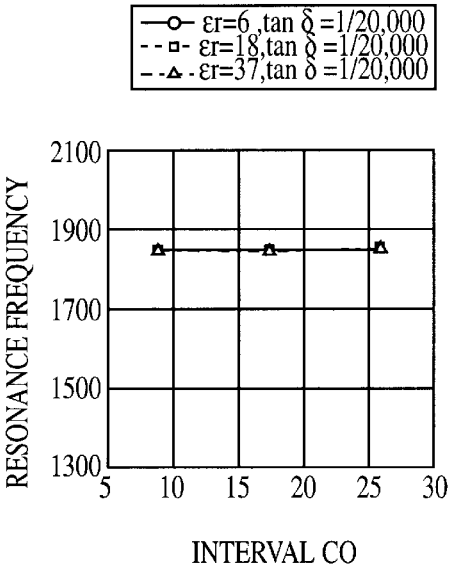
Figure 5C:
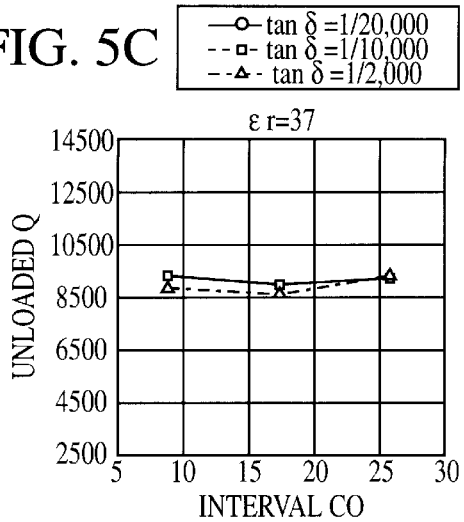
Figure 5D:
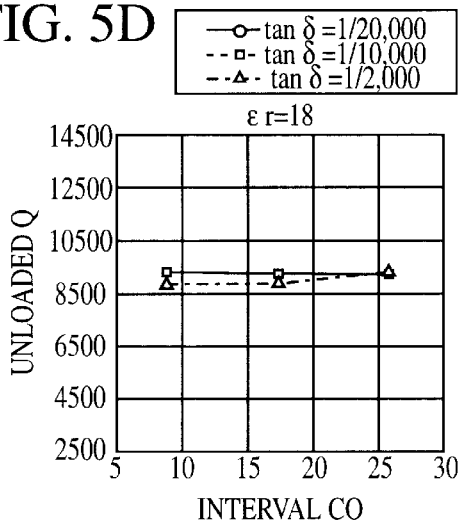
Figure 5E:
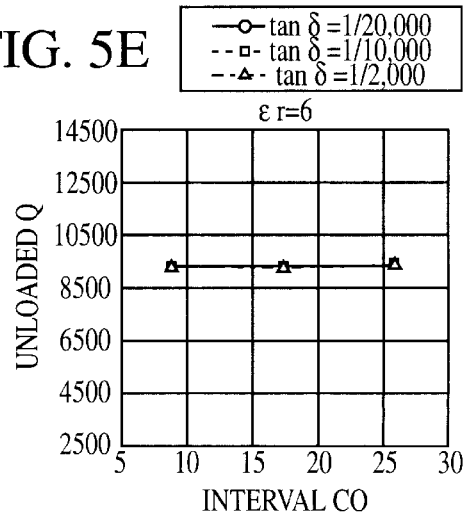
Figure 6A:
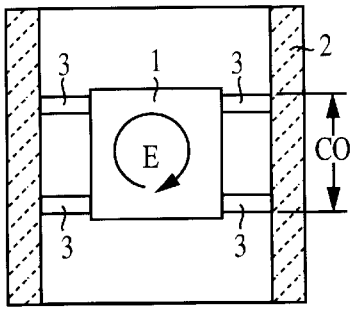
FIG. 6 illustrates the changes of the characteristics in the respective modes of the above resonator device, occurring when the intervals between the supports are changed.
Figure 6B:
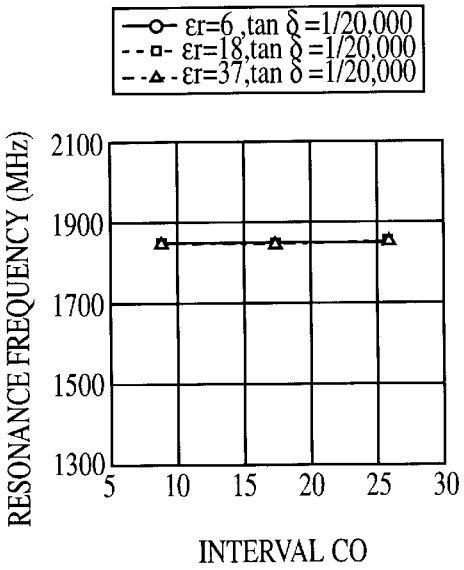
Figure 6C:
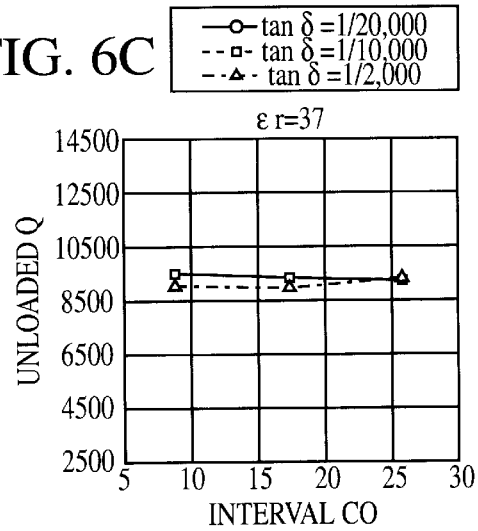
Figure 6D:
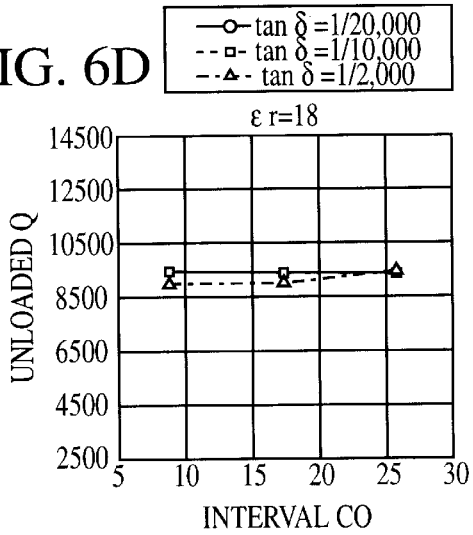
Figure 6E:
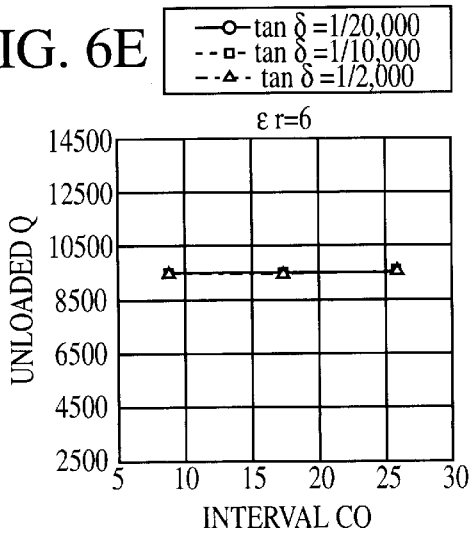
Figure 7A:
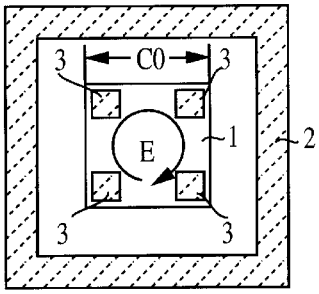
FIG. 7 illustrates the changes of the characteristics in the respective modes of the above resonator device, occurring when the intervals between the supports are changed.
Figure 7B:
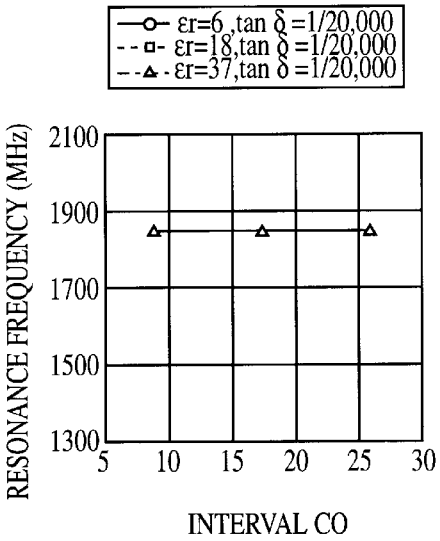
Figure 7C:
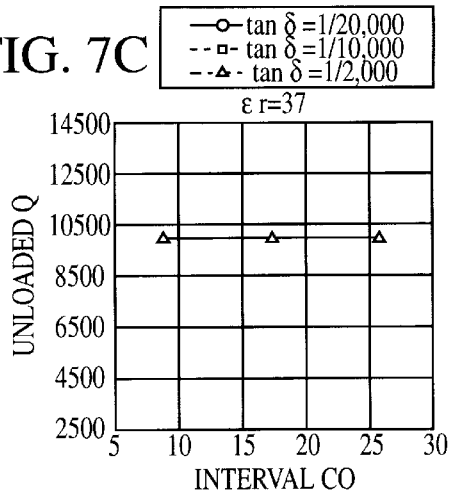
Figure 7D:
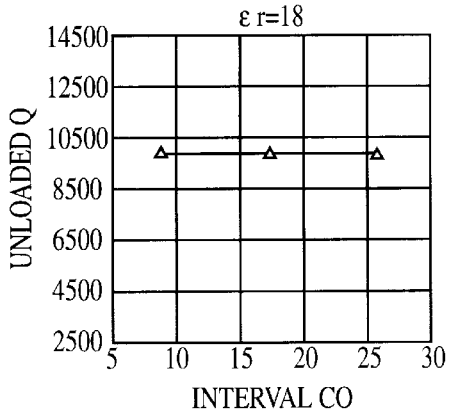
Figure 7E:
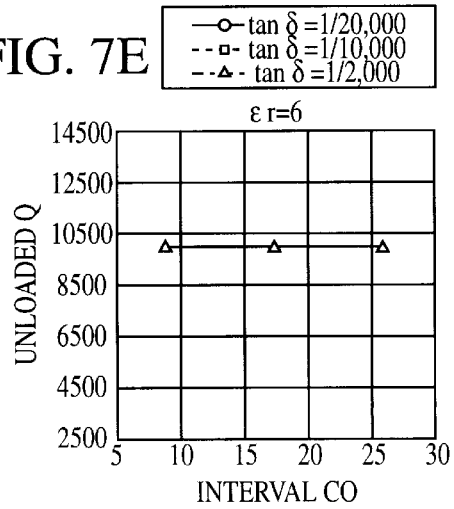
Figure 8A:
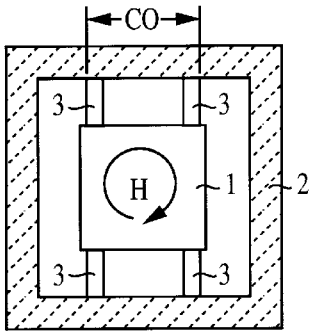
FIG. 8 illustrates the changes of the characteristics in the respective modes of the above resonator device, occurring when the intervals between the supports are changed.
Figure 8B:
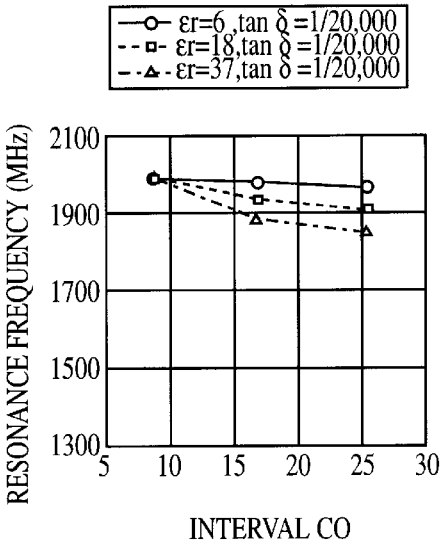
Figure 8C:
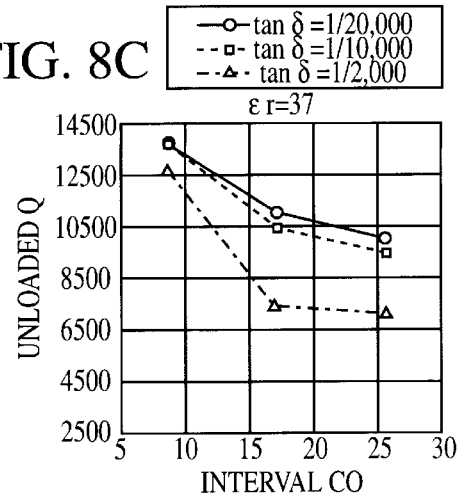
Figure 8D:
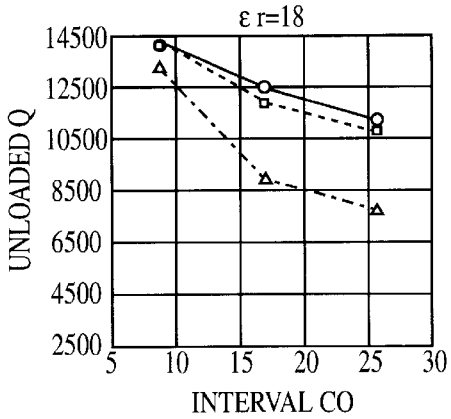
Figure 8E:
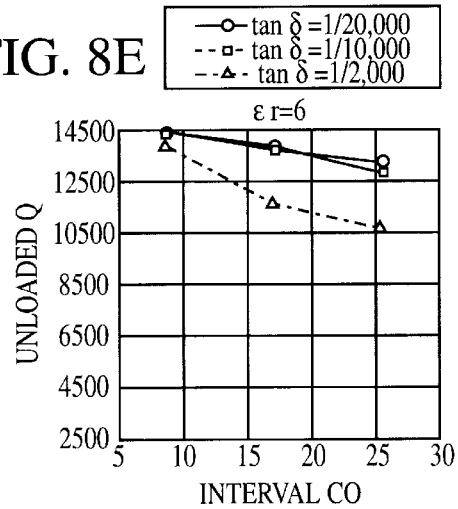
Figure 9A:
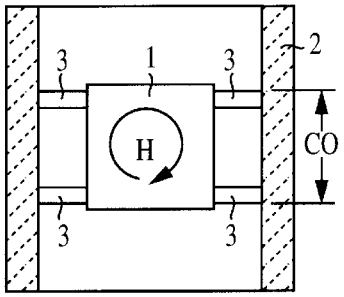
FIG. 9 illustrates the changes of the characteristics in the respective modes of the above resonator device, occurring when the intervals between the supports are changed.
Figure 9B:
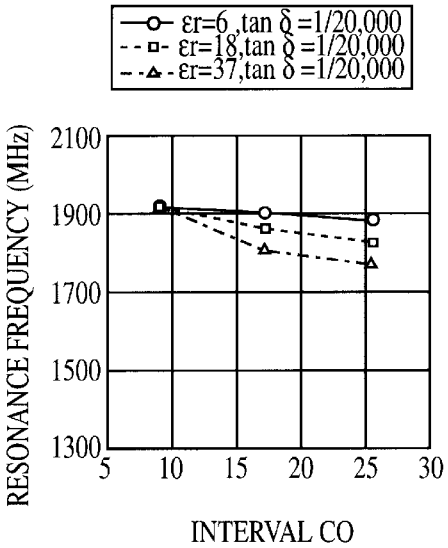
Figure 9C:
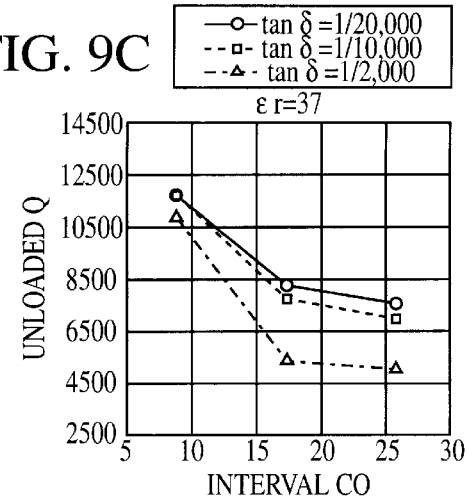
Figure 9D:
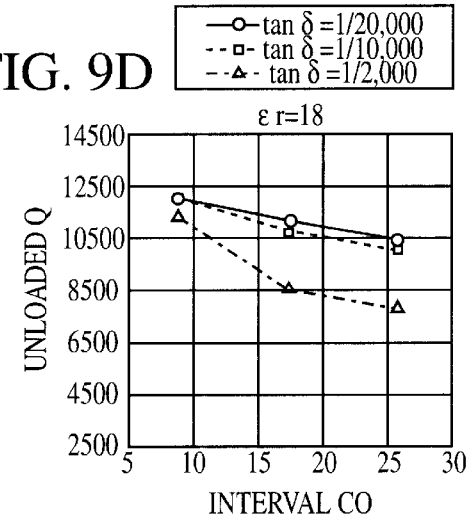
Figure 9E:
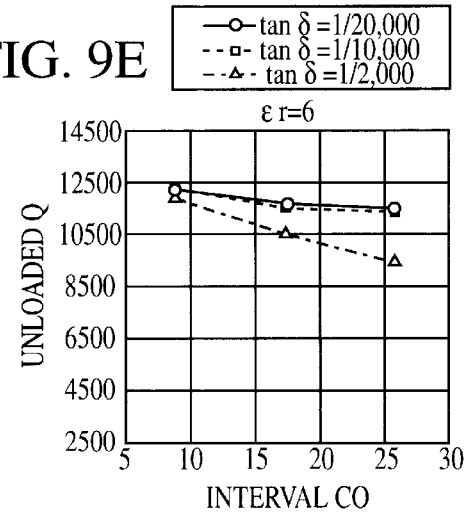
Figure 10A:
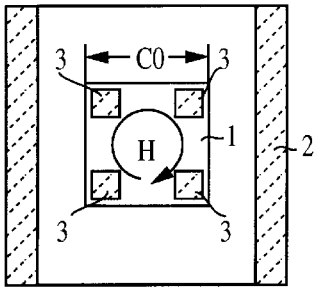
FIG. 10 illustrates the changes of the characteristics in the respective modes of the above resonator device, occurring when the intervals of supports are changed.
Figure 10B:
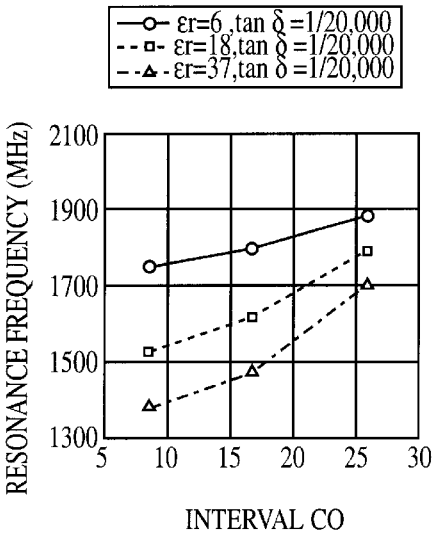
Figure 10C:
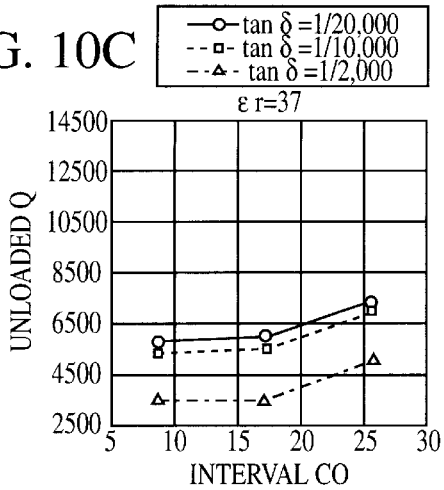
Figure 10D:
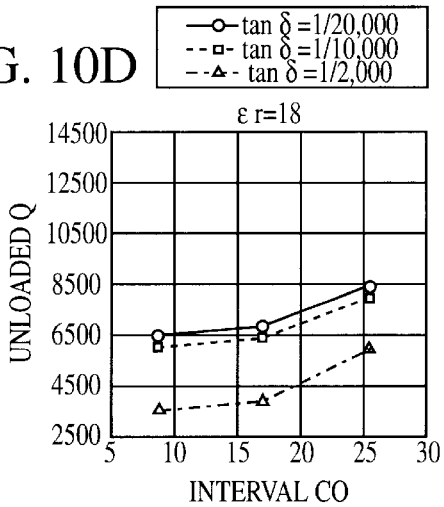
Figure 10E:
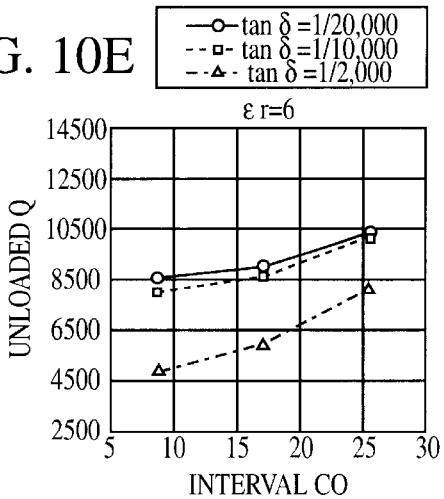
Figure 11A:
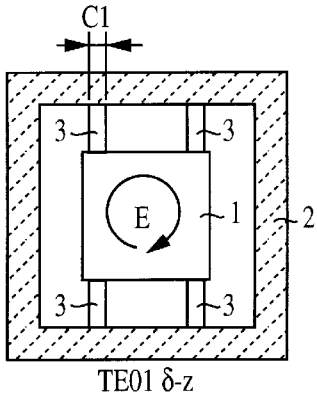
FIG. 11 illustrates the changes of the characteristics in the respective modes of the above resonator device, occurring when the thicknesses of the supports are changed.
Figure 11B:
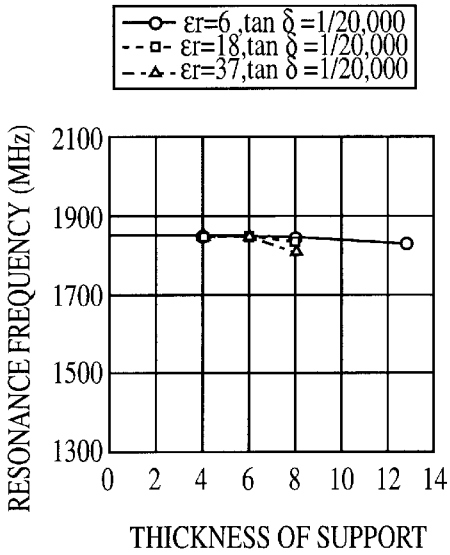
Figure 11C:
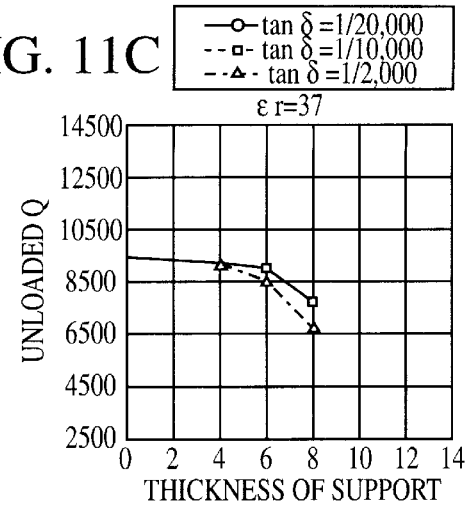
Figure 11D:
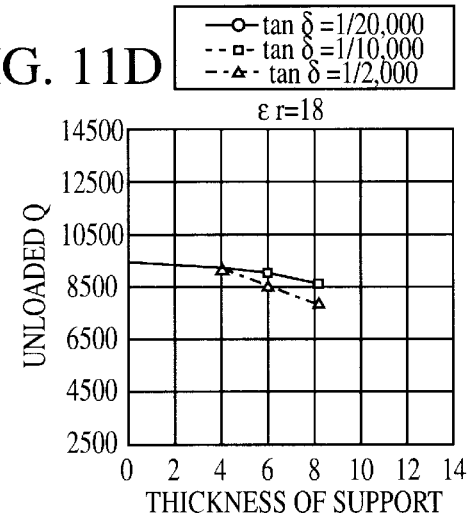
Figure 11E:
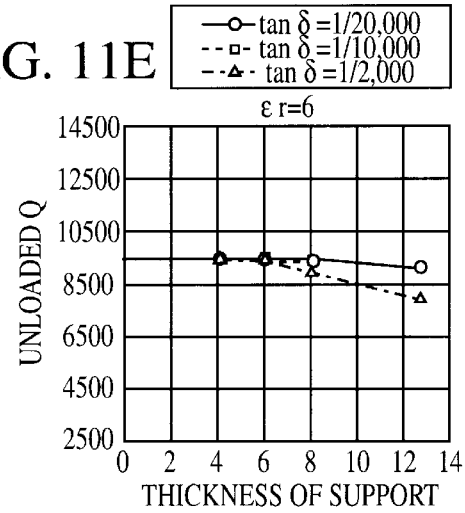
Figure 12A:
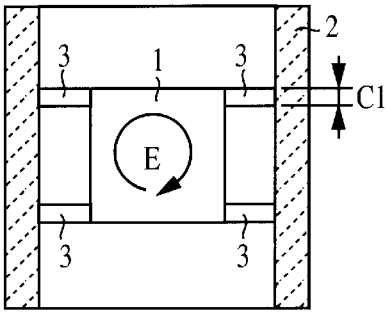
FIG. 12 illustrates the changes of the characteristics in the respective modes of the above resonator device, occurring when the thicknesses of the supports are changed.
Figure 12B:
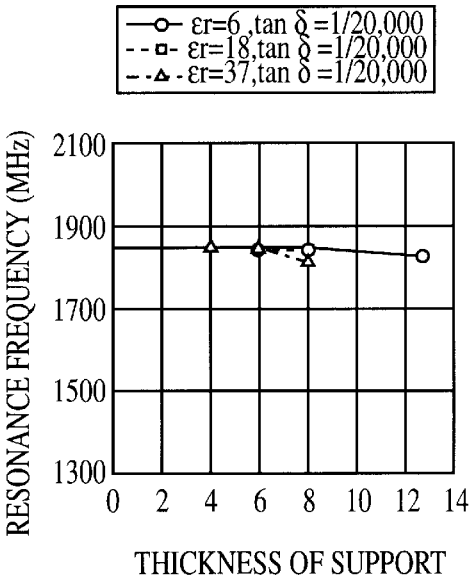
Figure 12C:
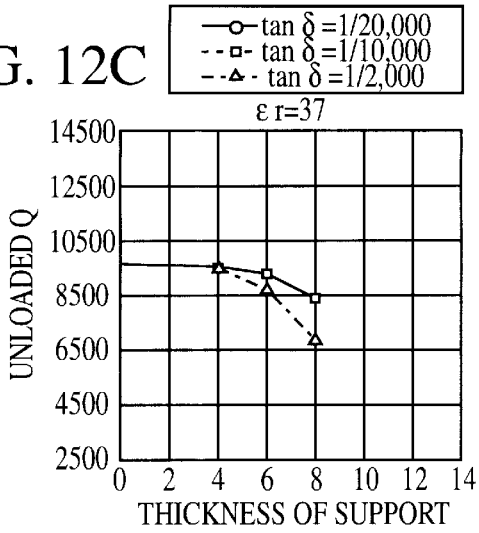
Figure 12D:
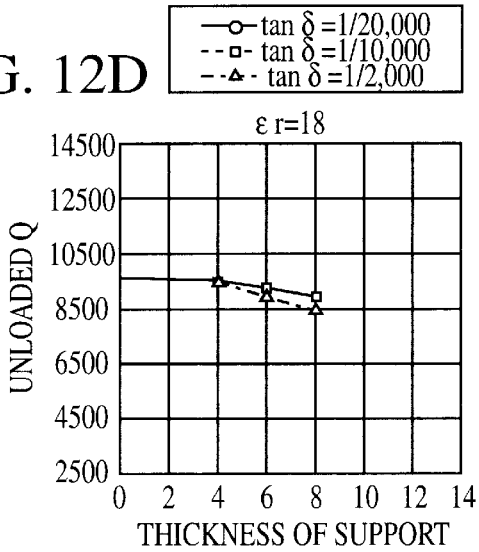
Figure 12E:
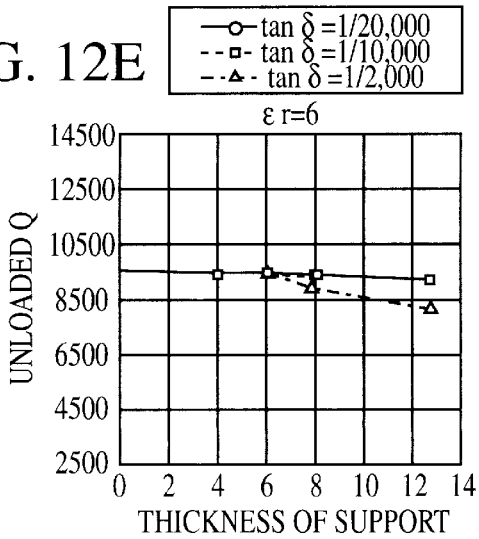
Figure 13A:
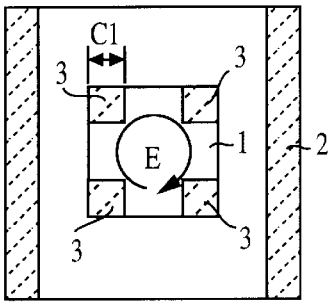
FIG. 13 illustrates the changes of the characteristics in the respective modes of the above resonator device, occurring when the thicknesses of the supports are changed.
Figure 13B:
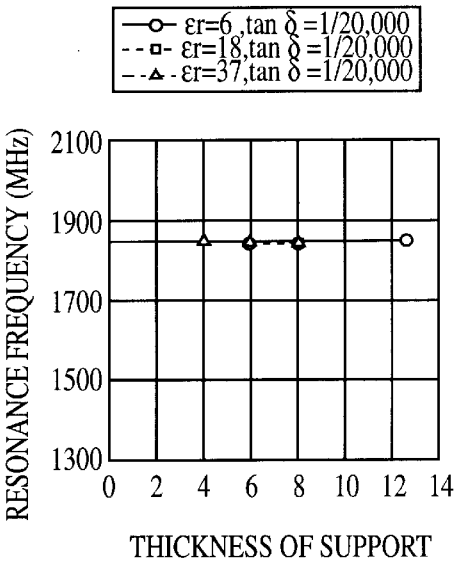
Figure 13C:
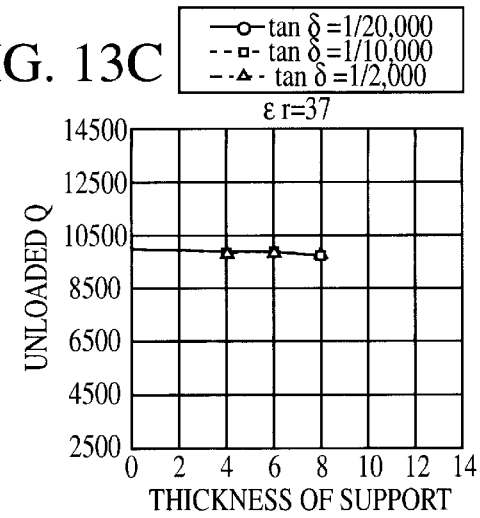
Figure 13D:
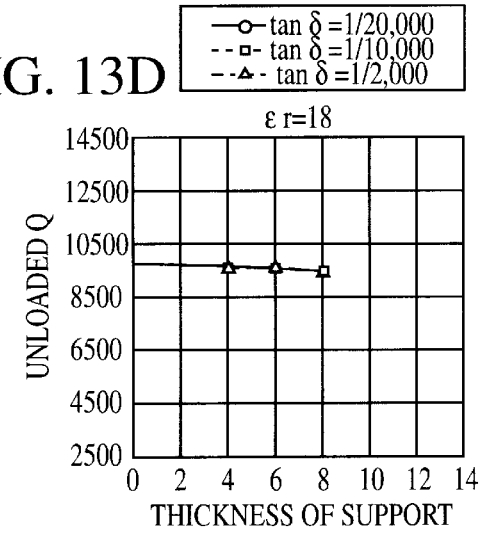
Figure 13E:
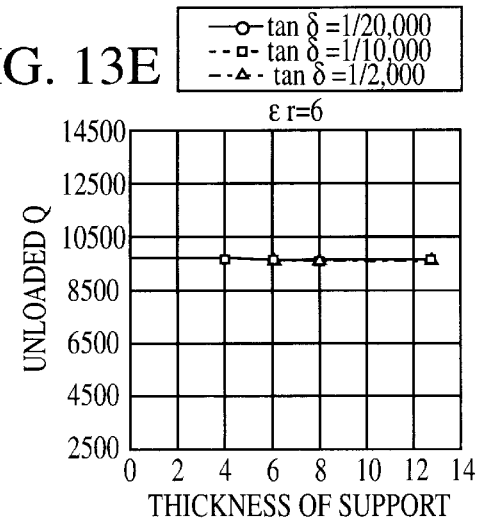
Figure 14A:
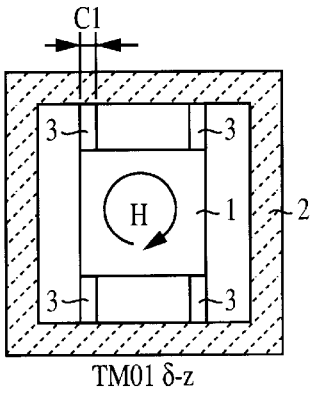
FIG. 14 illustrates the changes of the characteristics in the respective modes of the above resonator device, occurring when the thicknesses of the supports are changed.
Figure 14B:
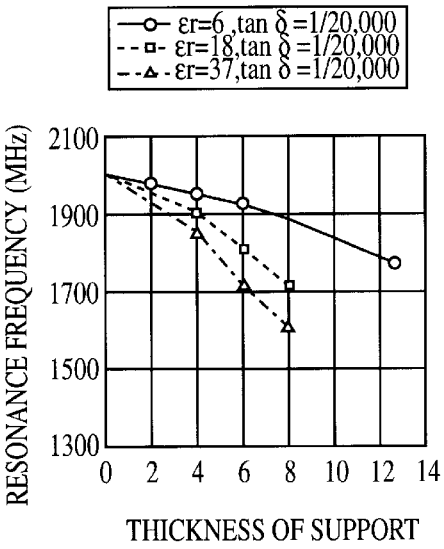
Figure 14C:
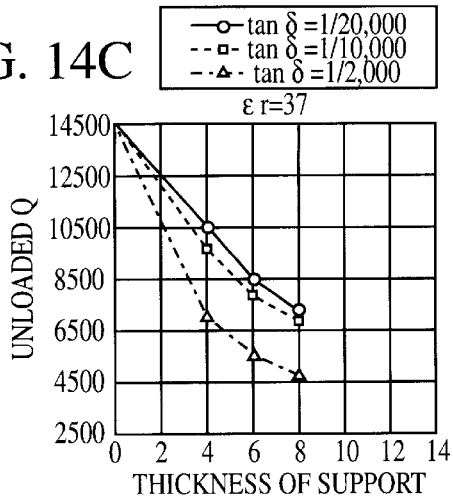
Figure 14D:
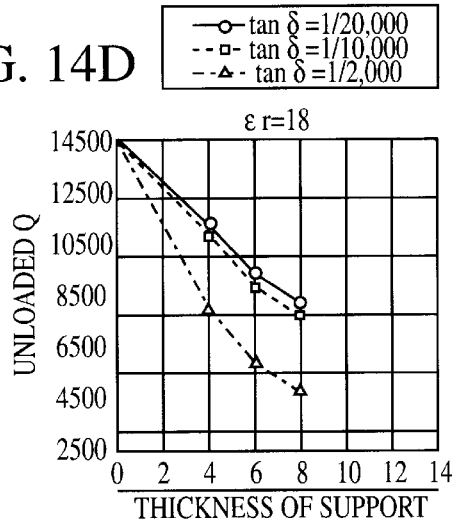
Figure 14E:
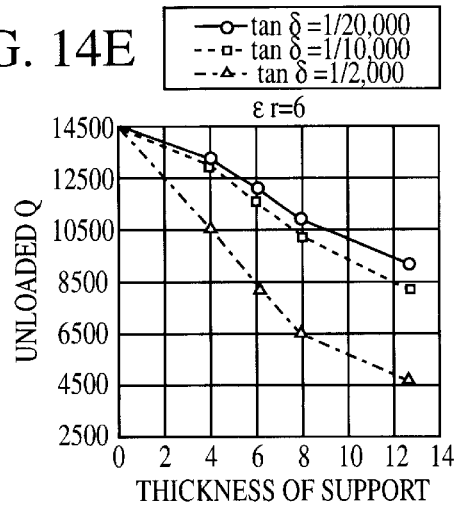
Figure 15A:
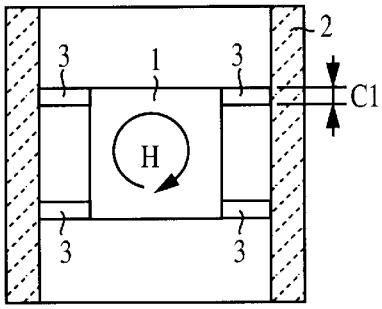
FIG. 15 illustrates the changes of the characteristics in the respective modes of the above resonator device, occurring when the thicknesses of the supports are changed.
Figure 15B:
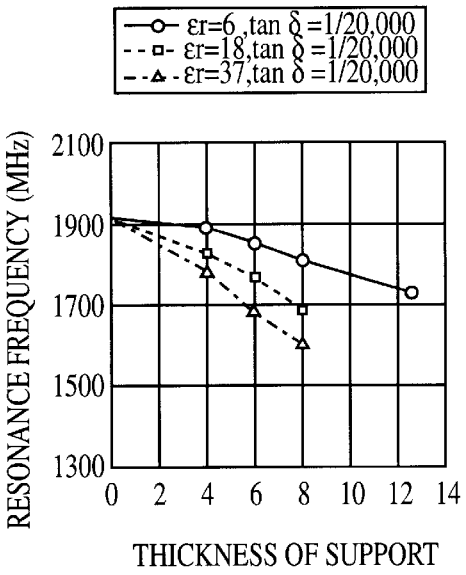
Figure 15C:
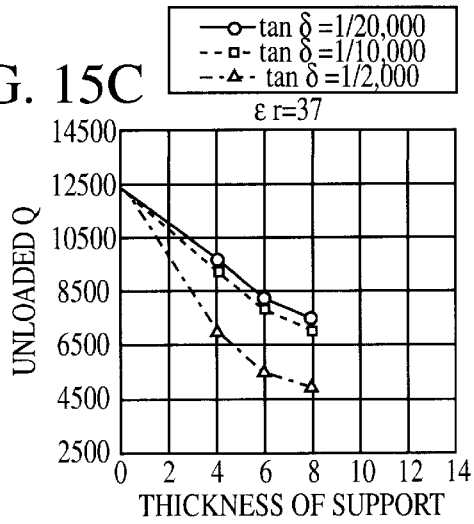
Figure 15D:
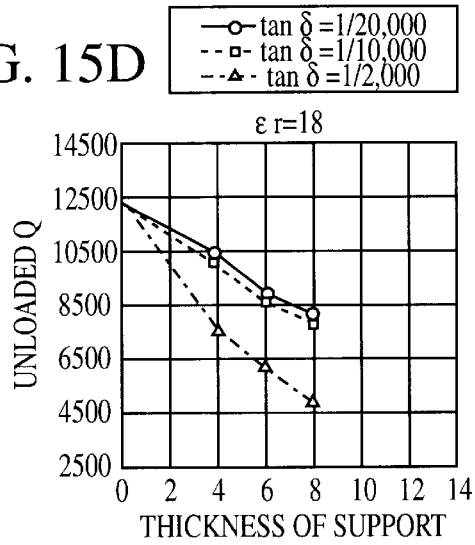
Figure 15E:
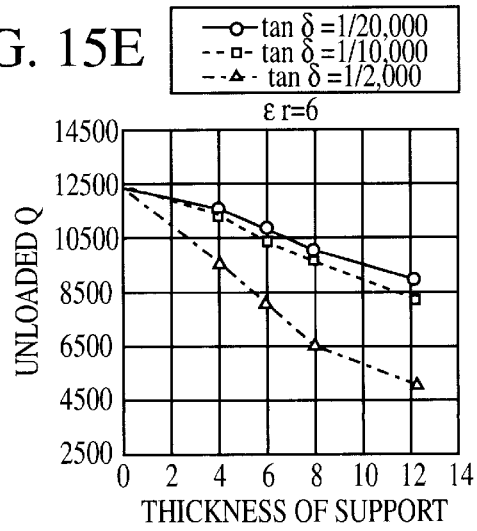
Figure 16A:
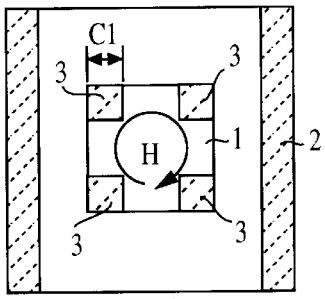
FIG. 16 illustrates the changes of the characteristics in the respective modes of the above resonator device, occurring when the thicknesses of the supports are changed.
Figure 16B:
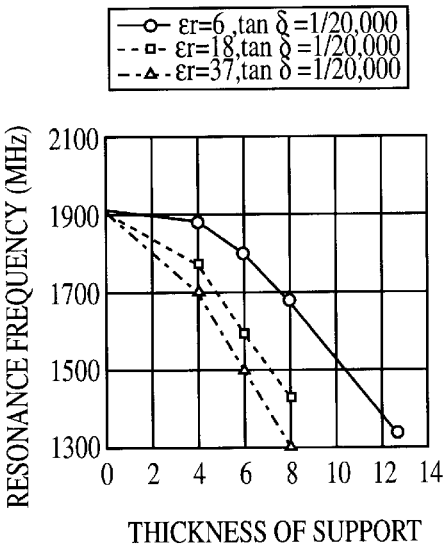
Figure 16C:
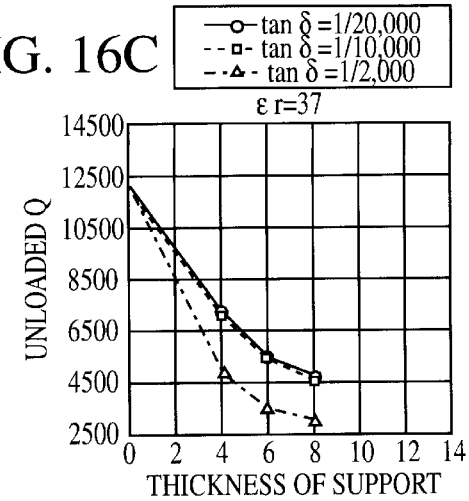
Figure 16D:
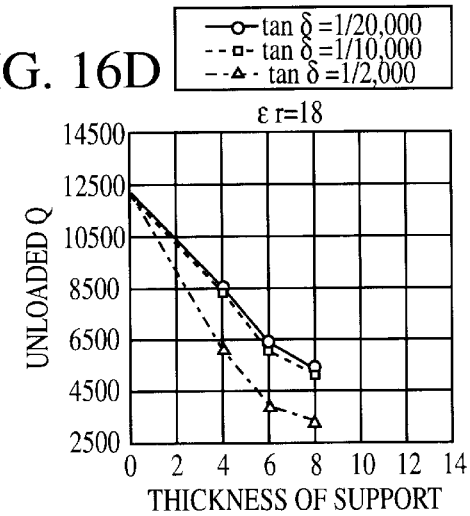
Figure 16E:
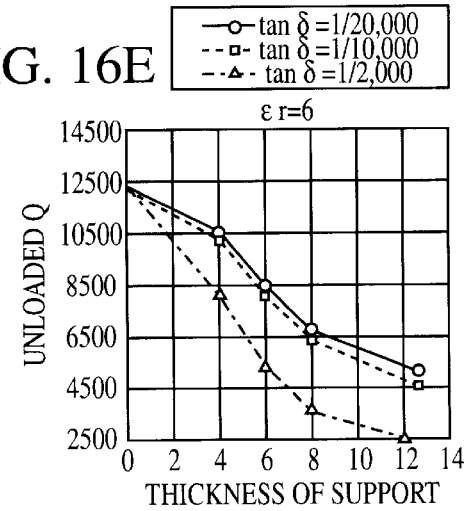

The resonance modes, caused by the dielectric core 1 shown in FIG. 1, are illustrated in FIGS. 2 to 4. In these figures, x, y, and z represent the co-ordinate axes in the three-dimensional directions as shown in FIG. 1. FIGS. 2 to 4 show the cross-sections of the respective two-dimensional planes, respectively. In FIGS. 2 to 4, a continuous line arrow indicates an electric field vector, and a broken line arrow indicates a magnetic field vector. Symbols "•" and "×" represent the direction of an electric field and that of a magnetic field, respectively. FIG. 2 to 4 show only a total of six resonance modes, namely, the TM01δ modes in the three directions, that is, x, y, and z directions, and the TE01δ modes in the three directions. In practice, higher resonance modes exist. In ordinary cases, these fundamental modes are used.

The characteristics of the multimode dielectric resonator device shown in FIGS. 1 to 4 are changed depending on the relative positional relations between the supports 3 and the dielectric core 1 or the cavity 2, and the properties of materials, which are illustrated in FIGS. 5 to 16 as an example.

FIGS. 5 to 10 show the change of the resonance frequency and that of the unload Q (hereinafter, referred to as $Q_0$), occurring when the intervals CO between the supports 3 are changed while the relative dielectric constant ϵ r and the tangent δ of the supports 3 are used as parameters. FIG. 5 shows the TE01δ−z, FIG. 6 the TE01δ−x, FIG. 7 the TE01δ−y, FIG. 8 the TM01δ−z, FIG. 9 the TM01δ−x and FIG. 10 the TM01δ−y, respectively. FIGS. 11 to 16 show the change of the resonance frequency and that of $Q_0$, occurring when the thickness C1 of the supports 3 is changed. FIG. 11 shows the TE01δ−z, FIG. 12 the TE01δ−x, FIG. 13 the TE01δ−y, FIG. 14 the TM01δ−z, FIG. 15 the TM01δ−x, and FIG. 16 the TM01δ−y, respectively. In these figures, in (A) shown are the cross sections in the respective modes, viewed in the electromagnetic wave propagation direction. Each of the dielectric cores 1, shown in these figures, is substantially a cube (regular hexahedron) with one side of 25.5 mm long. The relative dielectric constant ϵ r is 37, and tan δ is 1/20,000. The size of each inner wall of the cavity 2 is 31×31×31 mm, and the wall thickness is 2.0 mm. Accordingly, the size of each of the outer walls is 35×35×35 mm. A conductor film is formed on the outer wall surfaces. Accordingly, the cavity space defined by the conductor film has a size of 35×35×35 mm. Further, in FIGS. 5 to 10, the thickness of each support 3 is 4.0 mm.

As seen in the results shown in FIGS. 5 to 7, in the case of the TE modes, the resonance frequencies are constant, substantially irrespective of the intervals CO between the supports 3, and the relative dielectric constant ϵ r, and a high $Q_0$ is obtained, substantially irrespective of the ϵ r and the tan δ. On the other hand, in the TM modes, as shown in FIGS. 8 to 10, as the c r of the supports 3 is increased, the resonance frequency is reduced. As the tan δ is decreased, the $Q_0$ is reduced. Further, as shown in FIGS. 8 and 9, in the TM01δ−z and TM01δ−x modes where magnetic fields are distributed in a plane parallel to the directions in which the supports 3 are elongated, as the intervals CO between the supports 3 are wider, that is, as the supports 3 are nearer to the corner portions of the dielectric core 1, the $Q_0$ is decreased, and the resonance frequency is reduced. On the contrary, as shown in FIG. 10, in the TM01 δ−y mode where a magnetic filed H is distributed in a plane perpendicular to the directions in which the supports 3 are elongated, as the Co intervals become narrower, that is, the supports 3 are nearer to the center portion of the dielectric core 1, the $Q_0$ is reduced, and the resonance frequency is decreased.

Further, as seen in the results shown in FIGS. 11 to 13, in the TE modes, the resonance frequencies are constant, substantially irrespective of the thickness C1 of each support 3, the ϵ r, and the tan δ, and, relatively high $Q_0$ can be obtained. On the contrary, in the TM modes, as shown in FIGS. 14 to 16, as the ϵ r of the supports 3 is increased, the resonance frequencies are reduced. As the tan δ is decreased, the $Q_0$'s are reduced. Further, in any of the TM modes, as the thickness of the supports 3 is increased, the $Q_0$'s are considerably reduced, and the resonance frequencies are changed to a relatively high degree.

As seen in the above-description, in order to maintain the $Q_0$ at a high value in each TM mode, it is effective to thin the supports 3, reduce the relative dielectric constant, increase the tangent δ, and so forth. In addition, the $Q_0$ can be maintained at a high value by selecting the positions of the supports 3 in correspondence to a mode to be used. For example, when the TM01 δ−y mode is used, it is suggested to set the positions of the supports near to the corners of the dielectric core. Further, for the purpose of increasing the $Q_0$ to be as high as possible in the TM01δ−z or TM01 δ−x mode, not using the TM01 δ−y mode, it Is suggested to position the supports near to the center of the dielectric core. Moreover, even if the materials and sizes of the dielectric cores 1 are the same, it is possible to resonate the respective modes at predetermined resonance frequencies, by changing the thickness or the positions of the supports 3, and by changing the materials.

In the above-described embodiment, :means for coupling the respective resonance modes of the dielectric core and an external circuit is not illustrated. In the case where a coupling loop is used, an external coupling may be produced by arranging the coupling loop in the direction where a magnetic field in a mode to be coupled passes the coupling loop.

Next, the configuration of a multimode dielectric resonator device according to a second embodiment, in which the attachment positions of supports are varied, will be described with reference to FIGS. 17 to 21.

Figure 17:
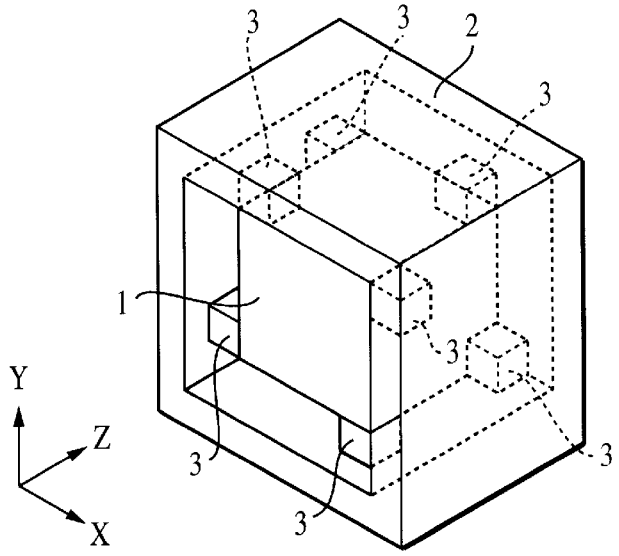
FIG. 17 is a perspective view showing the constitution of the basic portion of a multimode dielectric resonator device according to a second embodiment.

FIG. 17 is a perspective view showing the basic constitution portion of a multimode resonator device. In this figure, reference numerals 1, 2, and 3 designate a substantially parallelepiped-shaped dielectric core, an angular-pipe shaped cavity, and support's for supporting the dielectric core 1 substantially in the center of the cavity 2. A conductor film is formed on the outer peripheral surface of the cavity 2. In this embodiment, two supports 3 are provided on each of the four inner walls of the cavity. The other configuration is the same as that in the first embodiment.

Figure 18:
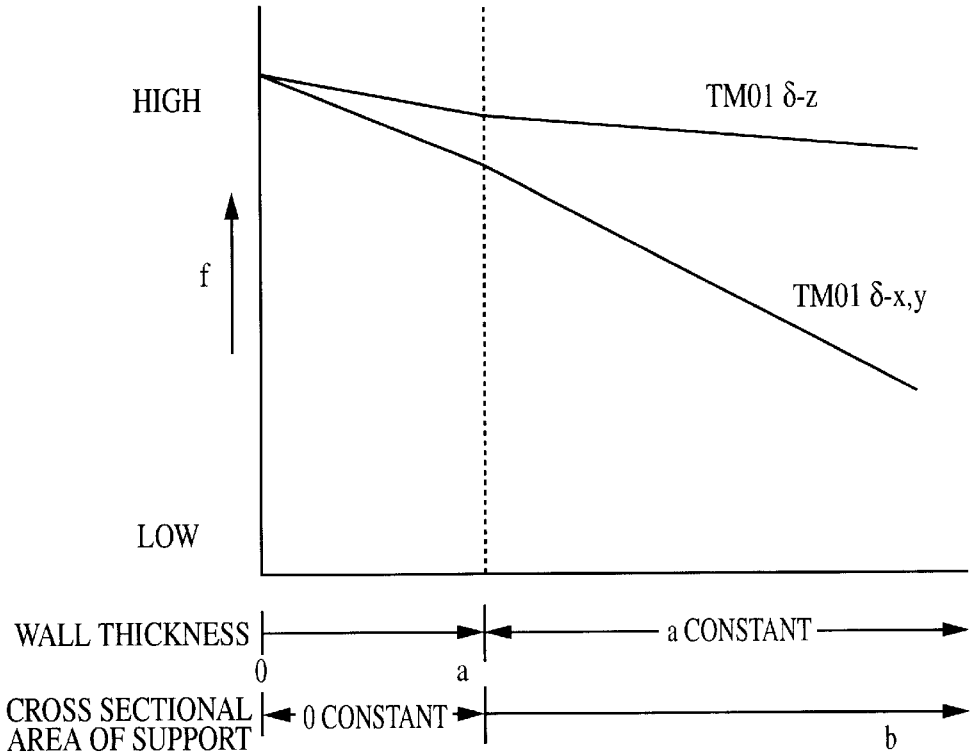
FIG. 18 is a graph showing the changes of the resonance frequencies in the respective modes of the above resonator device, occurring when the sizes of respective portions of the device are changed.

FIG. 18 shows the change of the resonance frequency of TM01δ–z and that of TM01 δ–x and TM01δ–y, occurring when the wall thickness of the cavity 2 in the multimode resonator device shown in FIG. 17 is varied from zero to a, and the cross sectional area of each support 3 is varied. In this second embodiment, the directions in which the supports 3 are protruded with respect to the dielectric core 1 lie in the x and y axial directions, not in the z axial direction. Therefore, as the cross sectional area b of the supports 3 is increased, the resonance frequencies of the TM01 δ–x and TM01 δ–y modes are considerably reduced as compared with the resonance frequency of the TM01 δ–z mode. Hereupon, since the positions where the supports 3 are protruded are equivalent with respect to the x and y axial directions, the TM01 δ–x mode and the TM01 δ–y mode are changed similarly to each other. Further, when the wall thickness of the cavity 2 is changed, the effects on the TM01 δ–x and TM01 δ–y modes are greater as compared with those on the TM01δ–z mode. Therefore, the change in wall thickness of the cavity causes the resonance frequencies of the TM01 δ–x and TM01 δ–y modes to change considerably. By setting the wall thickness of the cavity or the cross-sectional area of the supports by utilization of the above-described relation, the resonance frequencies of the TM01 δ–x and TM01δ–y modes and the resonance frequency of the TM01δ–z can be relatively changed. For example, by previously setting the thickness in the Z axial direction of the dielectric core it to be thick, the resonance frequencies of the three modes can be coincident with each other.

Figure 19:
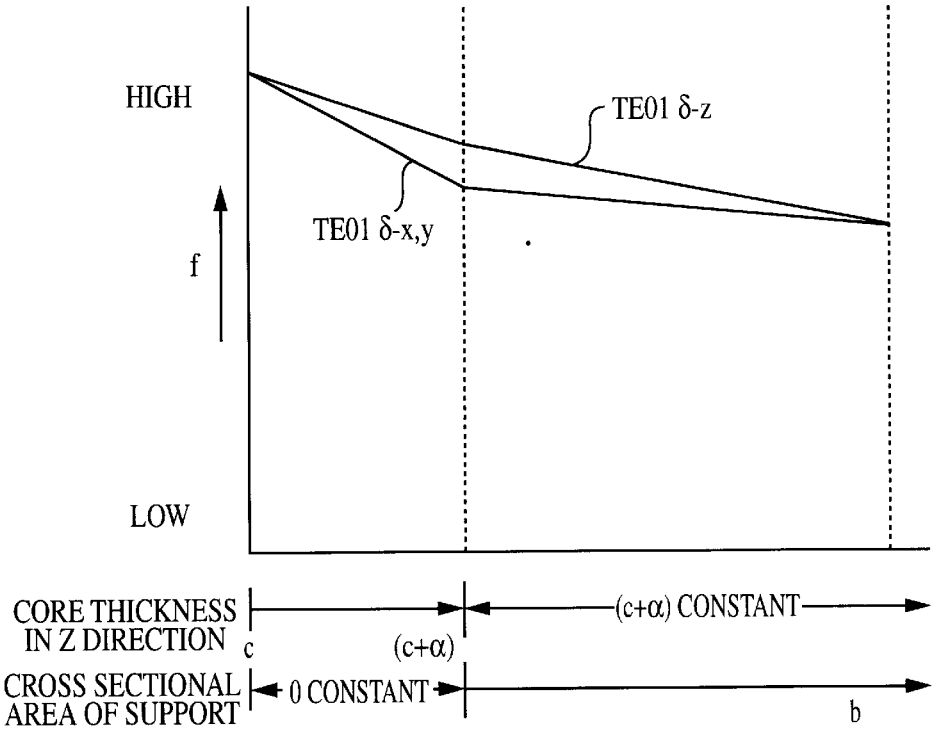
FIG. 19 is a graph showing the changes of the resonance frequencies in the respective modes of the above resonator device, occurring when the respective portions of the device are changed.

FIG. 19 shows the changes of the resonance frequencies of the TE01δ–x, TE01δ–y, and TE01δ–z modes, occurring when the thickness in the z axial direction of the dielectric core 1 and the cross sectional area of the supports 3, shown in FIG. 17, are varied. As illustrated, with the thickness in the z axial direction of the dielectric core being increased, the resonance frequencies of the TE01δ–x and TE01δ–y modes are reduced to a higher degree. Further, as the cross sectional area of each support is increased, the resonance frequency of the TE01δ–z mode is reduced more considerably. By designing appropriately the thickness in the z axial direction of the dielectric core 1 and the cross sectional area of each support 3 by utilization of these relations, the resonance frequencies of the three modes of TE01δ–x, TE01δ–y, and TE01δ–z can be ma de coincident with each other. Thus, by coupling predetermined resonance modes, the multistage can be realized.

In the above embodiment, means for coupling the respective resonance modes generated with the dielectric core is not illustrated. In the case where the TM modes are coupled to each other, or the TE modes are coupled to each other, it is suggested to provide a coupling hole at a predetermined position of the dielectric core in such a manner that the resonance frequencies of an even mode and an odd mode, which are the coupled-modes of the above-described both modes, have a difference. Further, when a TM mode and a TE mode are coupled to each other, it is suggested to couple both of the modes by breaking the balance of the electric field strengths of the both modes.

Figure 20:
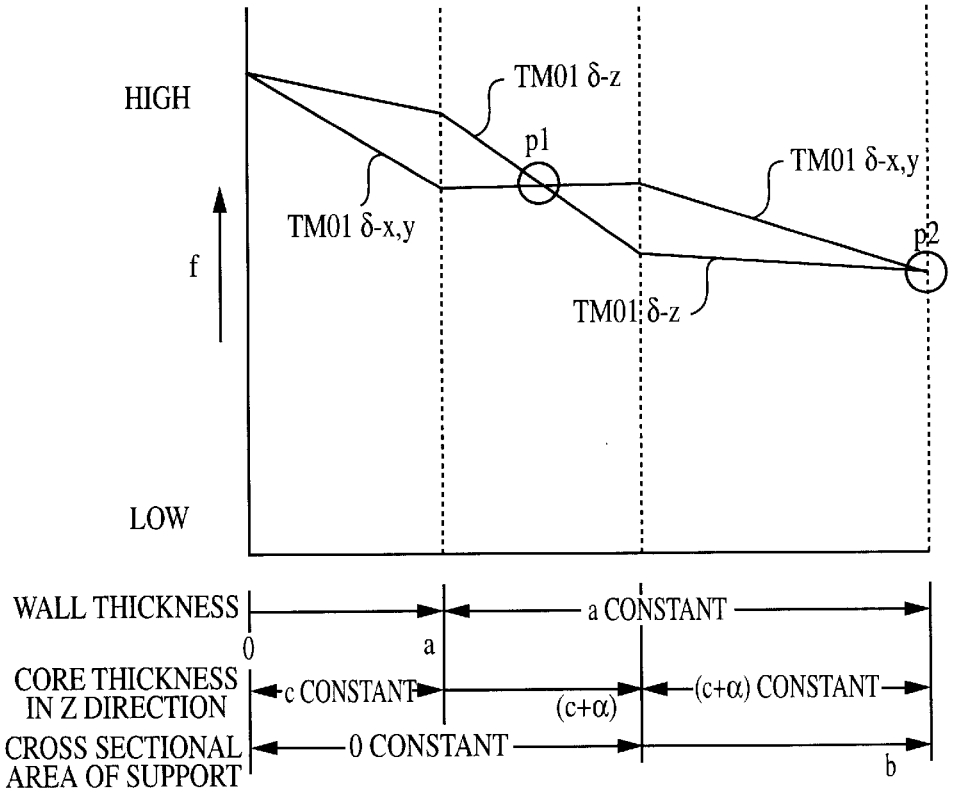
FIG. 20 is a graph showing the changes of the resonance frequencies in the respective modes of the above resonator device, occurring when the sizes of respective portions of the device are changed, respectively.

FIG. 20 shows the changes of the resonance frequencies of the above-described three TM modes, occurring when the wall thickness of the cavity 2, the thickness in the z axial direction of the dielectric core 1 and the cross sectional area of the supports 3, shown in FIG. 17, are varied. When only the wall thickness of the cavity is thickened, the resonance frequency of the TM01 δ–x, TM01 δ–y mode is reduced more considerably than that of the TM01δ–z mode. When the thickness in the z axial direction of the dielectric core is thickened, the resonance frequency of the TM01δ–z mode is reduced more considerably as compared with the resonance frequencies of the TM01δ–z and TM01δ–y modes. Further, when the thicknesses of the supports are thickened, the resonance frequencies of the TM01δ–x and TM01δ–y modes are reduced more considerably, as compared with the resonance frequency of the TM01δ–z model. By utilization of these relations, the resonance frequencies of the three modes can be made coincident with each other at characteristic points, indicated by p1 and p2 in the figure, for example.

Figure 21A:
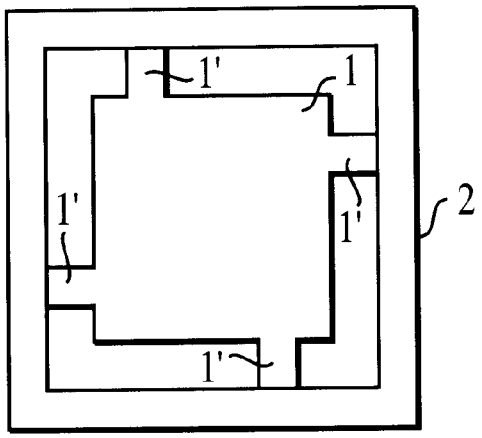
FIG. 21 shows a process of manufacturing the above resonator device.
Figure 21B:
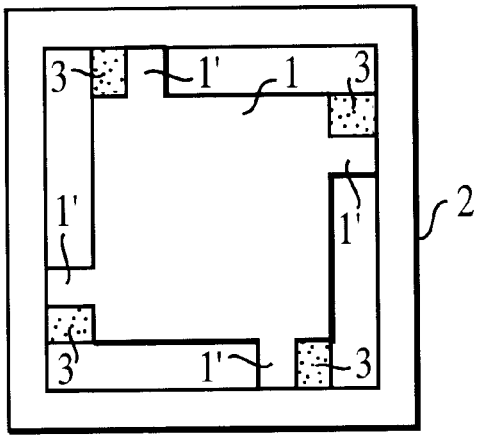
Figure 21C:
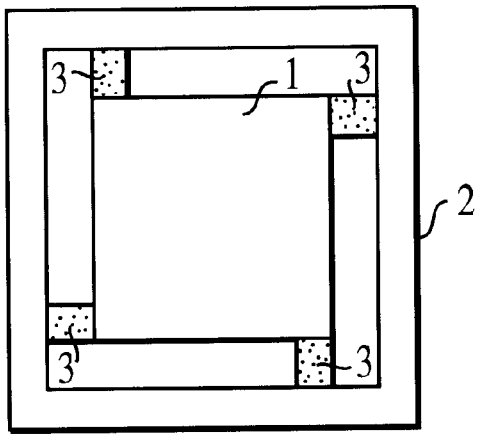

FIG. 21 shows an example of a process of producing the multimode dielectric resonator device shown in FIG. 17. First, as shown in (A), a dielectric core 1 is molded integrally with a cavity 2 in the state that the dielectric core 1 and the cavity 2 are connected by means of connecting parts 1'. Hereupon, molds for the molding are opened in the axial direction of the cavity 2, through the open faces of the angular pipe-shaped cavity 2. Subsequently, as shown in (B) of the same figure, supports 3 are temporarily bonded with a glass glaze in paste state, adjacently to the connecting parts 1' and in the places corresponding to the respective corner portions of the dielectric core 1. Further, Ag paste is applied to the outer peripheral surface of the cavity 2. Thereafter, the supports 3 are baked to bond to the dielectric core 1 and the inner walls of the cavity 2 (bonded with the glass glaze), simultaneously when an electrode film is baked. Thereafter, the connecting parts 1' are scraped off to produce the structure in which the dielectric core 1 is mounted in the center of the cavity 2 as shown in (C) of the same figure. In this case, for the dielectric core 1 and the cavity 2, a dielectric ceramic material of ZrO2-SnO2-TiO2 type with $\epsilon$ r=37 and tan δ=1/20,000 is used. For the supports 3, a low dielectric constant dielectric ceramic material of: 2MgO—SiO2 type with $\epsilon$ r=6 and tan δ=1/2,000 is used. Both have nearly the same liner expansion coefficients. No excess stress is applied to the bonding surfaces between the supports and the dielectric core or the cavity, when the dielectric core is heated, and the environmental temperature is changed.

Figure 22A:
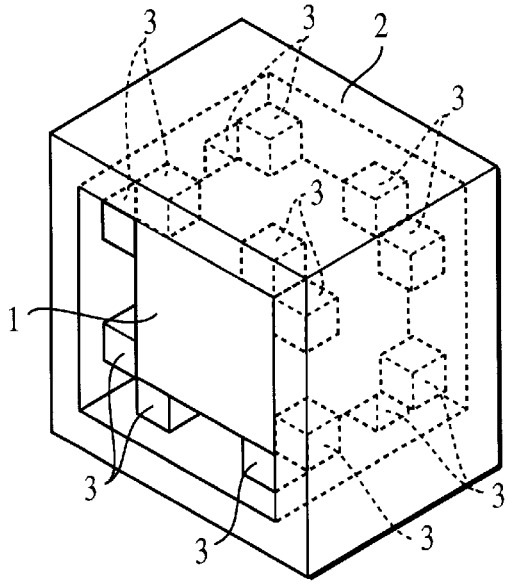
FIG. 22 consists of perspective views each showing the constitution of the basic portion of a multimode dielectric resonator device according to a third embodiment.
Figure 22B:
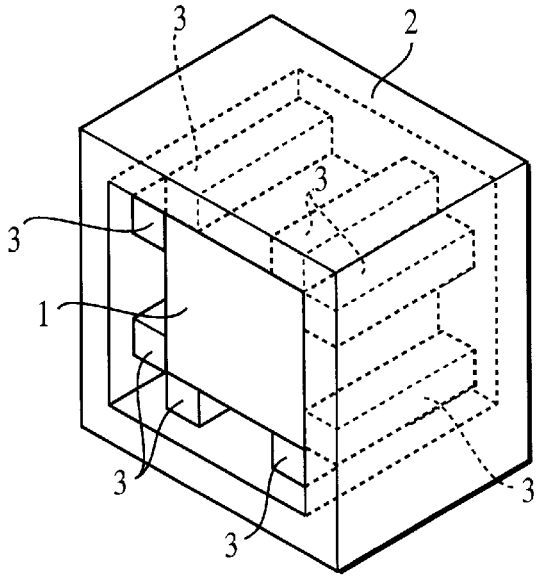

FIG. 22 is a perspective view showing the configuration of the fundamental portion of a multimode dielectric resonator device according to a third embodiment. In the example shown in FIG. 17, two supports 3 are provided on each of the four faces of the dielectric core 1, so that the dielectric core is supported in the cavity by a total of eight supports. On the other hand, regarding the supports, at least three supports may be provided for each of the four faces of dielectric core 1, as shown in FIG. 22 (A). Further, the supports may be continuous in a rib-shape as shown in (B) of the same figure. In these cases, for an external impact, a stress is dispersed by the supports 3, and thereby, even if the total cross sectional area of the supports 3 is reduced, correspondingly, predetermined mechanical strengths can be maintained.

Figure 23:
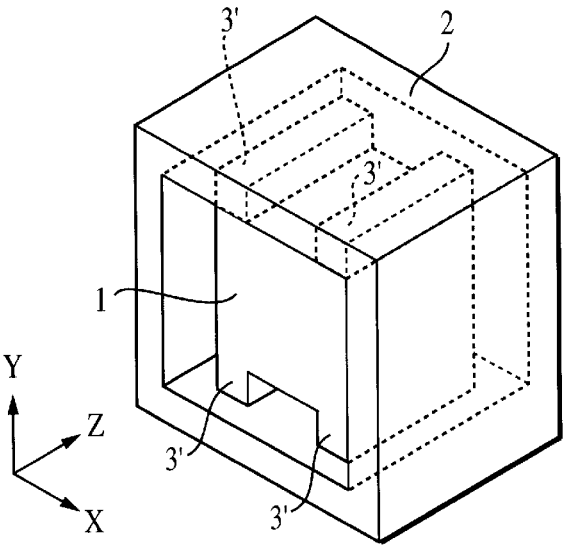
FIG. 23 is a perspective view showing the constitution of the basic portion of a multimode dielectric resonator device according to a fourth embodiment.

FIG. 23 is a perspective view showing the configuration of the fundamental portion of a multimode dielectric resonator device according to a fourth embodiment. In this figure, reference numeral 3' designates a support formed by molding integrally with a dielectric core 1 and a cavity 2. Like this, by shaping the support 3' such that it is different in the respective axial directions of x, y, and z, especially, the resonance frequencies in the three modes, that is, the TM01 δ–x, TM01 δ–y, and TM01δ–z modes can be designed desirably to some degree.

Figure 24:
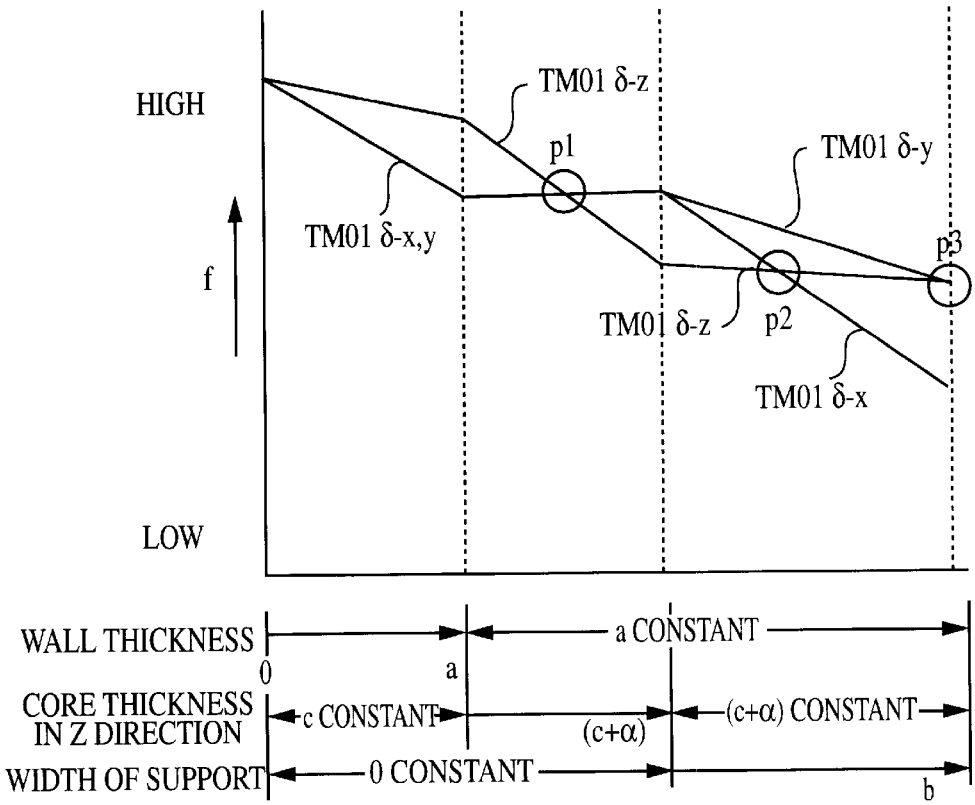
FIG. 24 is a graph showing the changes of the resonance frequencies in the respective modes of the above resonator device, occurring when the sizes of respective portions of the device are changed.

FIG. 24 illustrates the example. As the wall thickness a of the cavity is thickened, the resonance frequencies of the TM01 δ–x and TM01 δ–y modes are reduced more considerably as compared with the resonance frequency of the TM01δ–z mode. As the thickness in the z axial direction of the dielectric core is thickened, the resonance frequency of the TM01δ–z mode is more reduced as compared with the resonance frequencies of the TM01 δ–x and TM01 δ–y modes. Further, as the width of each support 3' is widened, the resonance frequency of the TM01 δ–x mode is reduced more considerably than that of the TM01 δ–y mode, and the resonance frequency of the TM01 δ–y mode is reduced more considerably than that of the TM01δ–z. As seen in these relations, the resonance frequencies in the three modes can be made coincident at a characteristic point indicated by p1 in the figure. The resonance frequencies in the two modes can be made coincident with each other at characteristic points indicated by p2 or p3.

Figure 25:
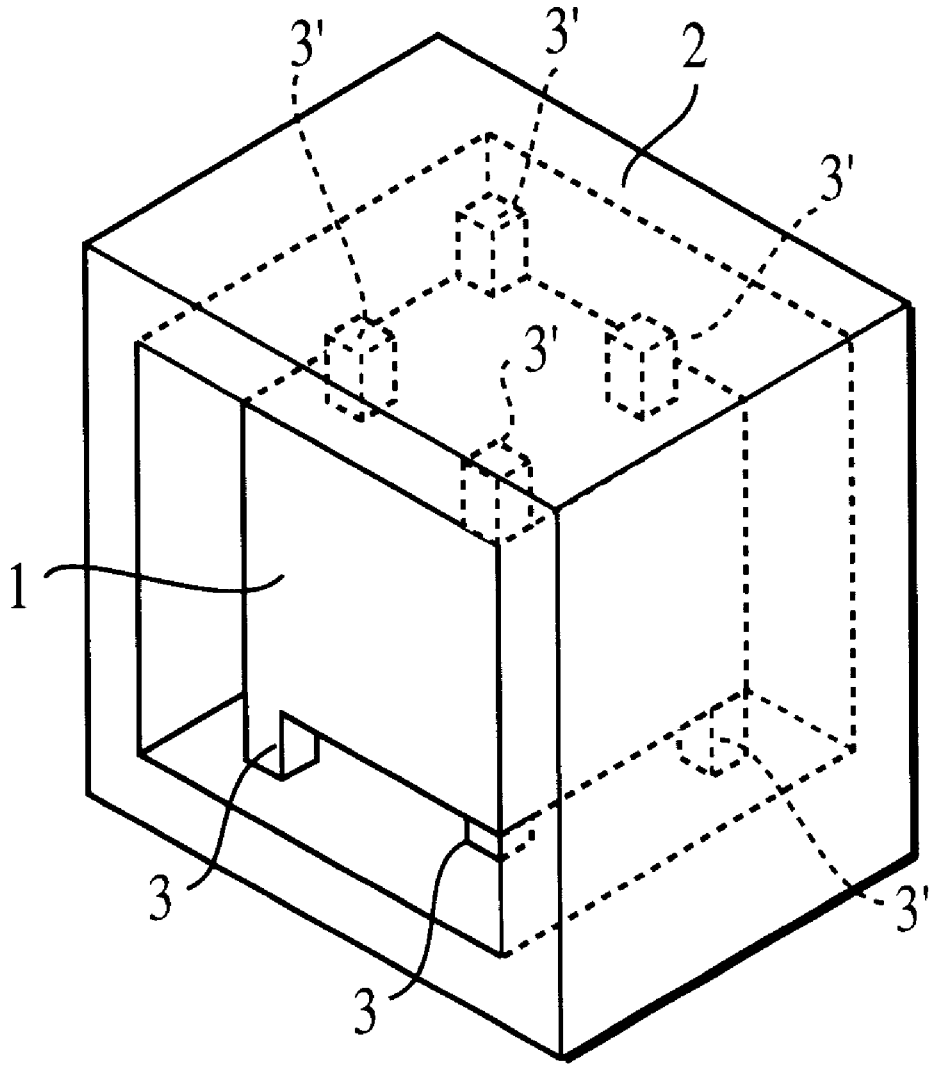
FIG. 25 is a perspective view showing the configuration of the basic portion of a multimode dielectric resonator device according to a fifth embodiment.

FIG. 25 is a perspective view showing the configuration of the basic portion of a multimode dielectric resonator device according, to a fifth embodiment. In this figure, reference numeral 3' designates a supporting portion formed by molding integrally with a dielectric core 1 and a cavity 2. In the example shown in FIG. 1, the supports 3 are provided in the four corners on the upper side and the underside, viewed in the figure, of the dielectric core 1, respectively. On the other hand, in the example shown in FIG. 25, some of the supporting portions 3' are provided in corner portions of the dielectric core,land the others are provided in separation from the corner portions. As described previously, the $Q_0$ and the resonance frequency are changed, depending of the relative positional relation between the dielectric core and the supporting portions. Accordingly, by designing the positions of the supporting portions 3' in correspondence to a resonance mode to be used, the resonance frequency in the predetermined mode can be set at a predetermined value without the $Q_0$being reduced considerably. By disposing the respective supporting portions at shifted positions having such a positional relation that the respective supports clan be seen when viewed through each open-face of the cavity, the device can be integrally molded easily by means of a two-piece mold.

In the above respective embodiments, it is described that the supports as parts separated from the dielectric core and the cavity are used, or the supports are molded integrally with the dielectric core and the cavity, as an example. The supports may be molded integrally with the dielectric core and bonded to the inside of the cavity,.or the supports may be molded integrally with the cavity, and the dielectric core may be bonded to the supports.

Hereinafter, an example of forming dielectric resonator devices such as various filters, synthesizers distributors, and so forth by using plural resonance modes will be described with reference to FIG. 26.

Figure 26A:
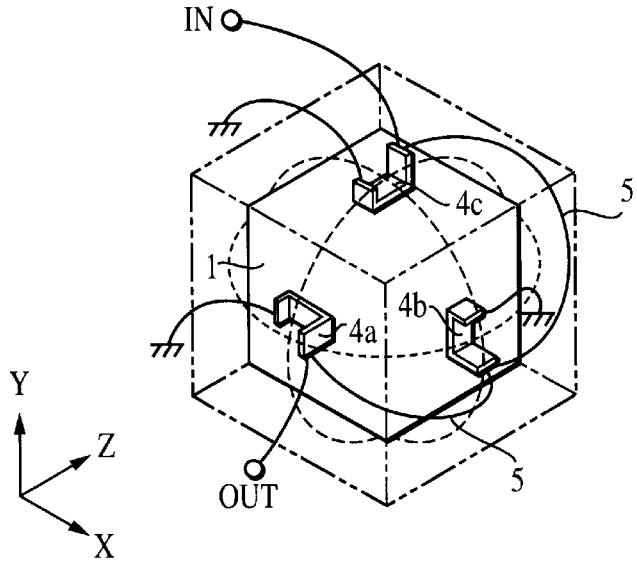
FIG. 26 is a perspective view showing the configuration of the basic portion of a multimode dielectric resonator device according to a sixth embodiment.
Figure 26B:
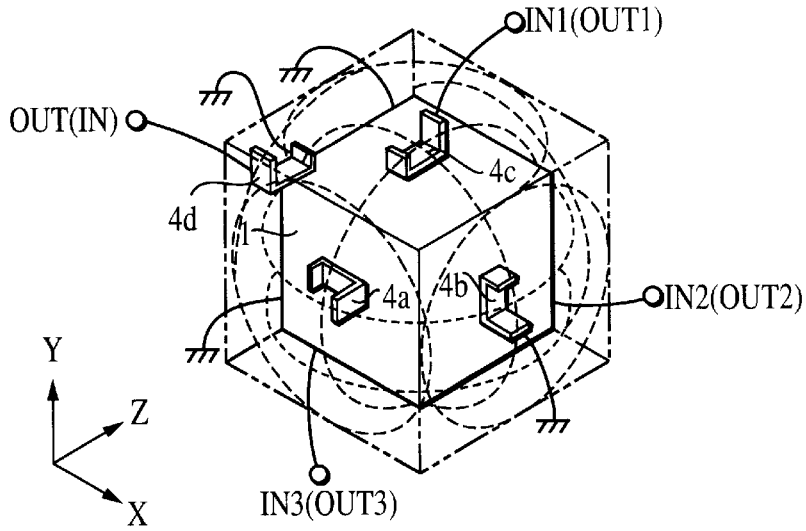
Figure 27A:
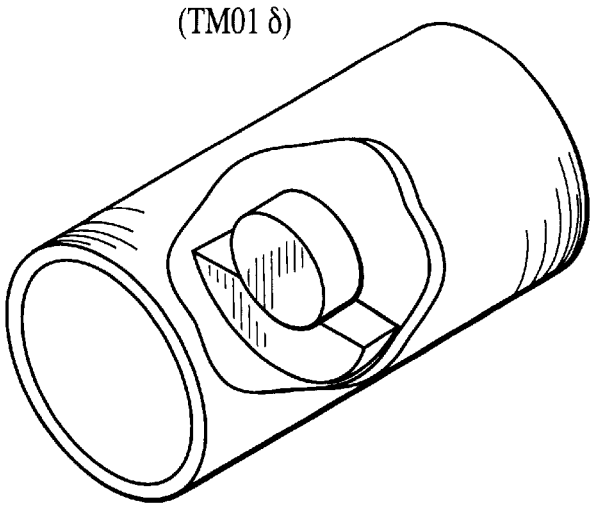
FIG. 27A PRIOR ART
FIG. 27 consists of partially exploded perspective views each showing an example of the configuration of a conventional dielectric resonator device.
Figure 27B:
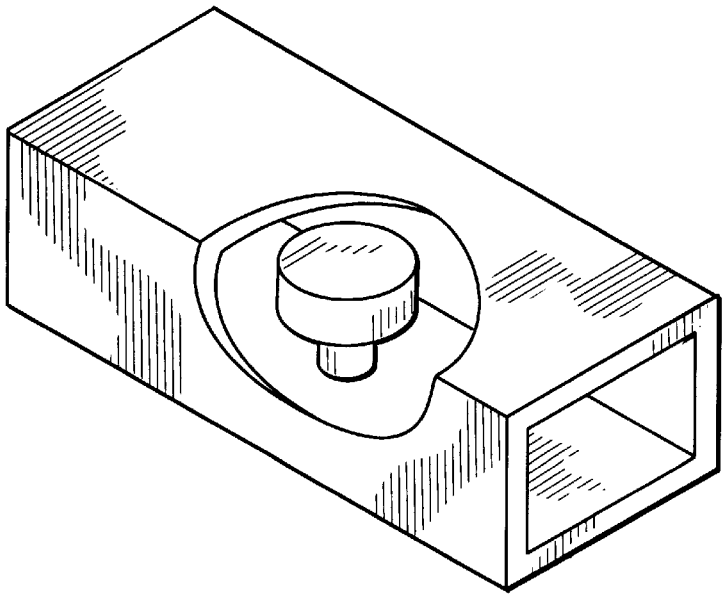
FIG. 27B PRIOR ART
Figure 28A:
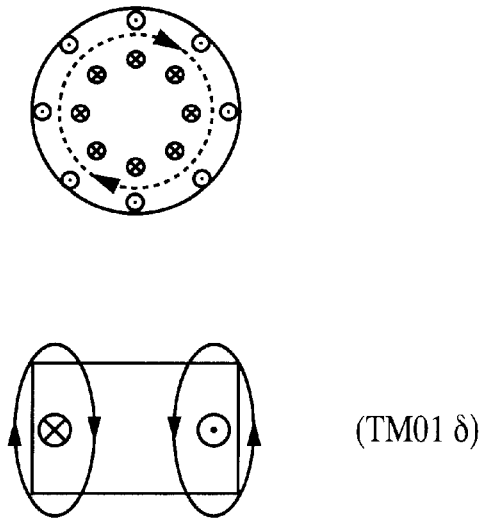
FIG. 28A PRIOR ART
FIG. 28 illustrates the electromagnetic field distributions as an example of a conventional single mode dielectric resonator.
Figure 28B:
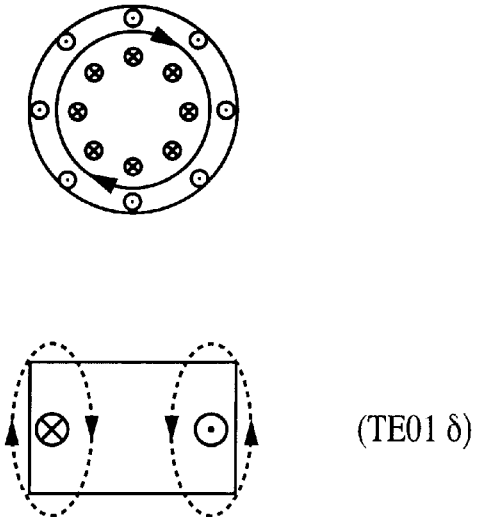
FIG. 28B PRIOR ART

In FIG. 26, the alternate long and two short dashes line represents a cavity. In the cavity, a dielectric core 1 is disposed. A supporting structure for the dielectric core 1 is omitted. In (A) of this figure, the formation of a band rejection filter is illustrated, as an example. Reference numerals 4*a,* 4*b,* and 4*c* each represent a coupling loop. The coupling loop 4*a* is coupled to a magnetic field (magnetic field in the TM01 δ–x mode) in a plane parallel to the y–z plane, the coupling loop 4*b* is coupled to a magnetic field (magnetic field in the TM01 δ–y mode) in a plane parallel to the x–z plane, and the coupling loop 4*c* is coupled to a magnetic field (magnetic field in the TM01 δ–z mode) in a plane parallel to the x–y plane. One end of each of these coupling loops 4*a,* 4*b* and 4*c* is grounded. The other ends of the coupling loops 4*a* and 4*b,* and also, the other ends of the coupling loops 4*b* and 4*c* are connected to each other through transmission lines 5, 5 each having an electrical length which is equal to λ/4 or is odd-number times of λ/4, respectively. The other ends of the coupling loops 4*a,* 4*c* are used as signal input-output terminals. By this configuration, a band rejection filter is obtained in which adjacent resonators of the three resonators are connected to a line with a phase difference of π/2.

FIG. 26 (B) shows an example of forming a synthesizer or a distributor. Hereupon, reference numerals 4*a,* 4*b,* 4*c,* and 4*d* designate coupling loops. The coupling loop 4*a* is coupled to a magnetic field (magnetic field in the TM01 δ–x mode) in a plane parallel to the y–z plane. The coupling loop 4*b* is coupled to a magnetic field (magnetic field in the TM01 δ–y mode) in a plane parallel) to the x–z plane. The coupling loop 4*c* is coupled to a magnetic filed (magnetic field in the TM01δ–z mode) in a plane parallel to the x–y plane. Regarding the coupling loop 4*d,* the loop plane is inclined to any of the y–z plane, the x–z plane, and the x–y plane, and coupled to magnetic fields in the above three modes, respectively. One ends of these coupling loops are grounded, respectively, and the other ends are used as signal input or output terminals. In particular, when the device is used as a synthesizer, a signal is input through the coupling loops 4*a,* 4*b*, and 4*c*, and outputs from the coupling loop 4*d*. When the device is used as a distributor, a signal is input through the coupling loop 4*d*, and output from the coupling loops 4*a*, 4*b*, and 4*c*. Accordingly, a synthesizer with three inputs and one output or a distributor with one input and three outputs are obtained.

Similarly, a band pass filter can be formed by coupling predetermined resonance modes through a coupling loop, and a transmission line, if necessary.

In the above example, the three resonance modes are utilized. At least four modes may be utilized. Further, a composite filter in which a band pass filter and a band rejection filter are combined can be formed by coupling some of the plural resonance modes sequentially to form the band pass filter, and making the other resonance modes independent to form the band rejection filter.

Next, an example of a triple mode dielectric resonator device will be described with reference to FIGS. 29 to 33.

Figure 29:
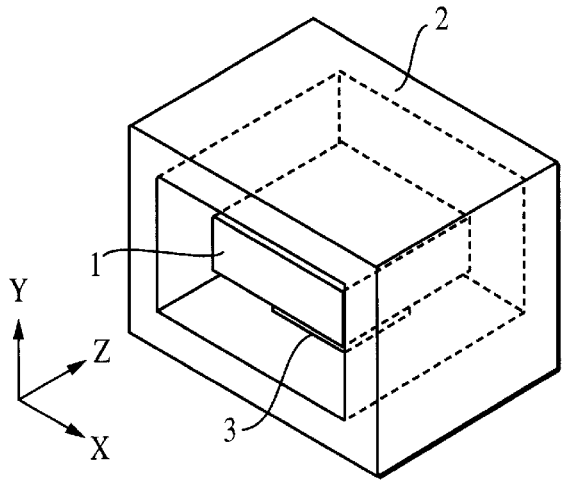
FIG. 29 is a perspective view showing the configuration of the basic portion of a multimode dielectric resonator device according to a seventh embodiment.

FIG. 29 is a perspective view showing the basic constitution portion of a triplex mode dielectric resonator device. In this figure, reference numeral 1 designates a square plate-shaped dielectric core of which two sides have substantially the same lengths, and the other one side is shorter than each of the two sides. The reference numerals 2 and 3 designate an angular pipe-shaped cavity and a support for supporting a dielectric core 1 substantially in the center of the cavity 2, respectively. A conductor film is formed on the outer peripheral surface of the cavity 2. Dielectric sheets each having a conductor film formed thereon or metal sheets are disposed on the two open faces to constitute a substantially parallelepiped-shaped shield space. Further, to an open-face of the cavity 2, an open-end of another cavity is opposed, so that electromagnetic fields in predetermined resonance modes are coupled to each other to realize a multi-stage.

The supports 3 shown in FIG. 29, made of a ceramic material having a lower dielectric constant than the dielectric core 1, are disposed between the dielectric core 1 and the inner walls of the cavity 2, respectively, and fired to be integrated. The dielectric core may be disposed in a metallic case, not using the ceramic cavity as shown in FIG. 29.

Figure 30:
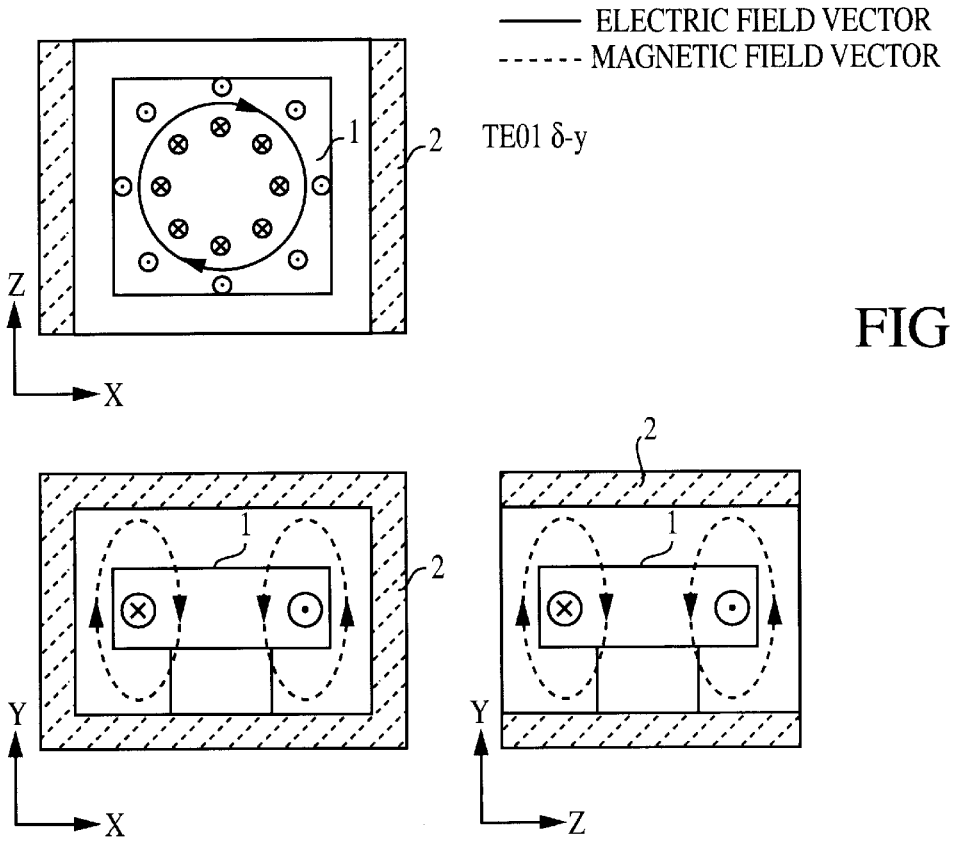
FIG. 30 consists of cross sections each showing the electromagnetic field distributions in the respective modes of the above resonator device.
Figure 31:
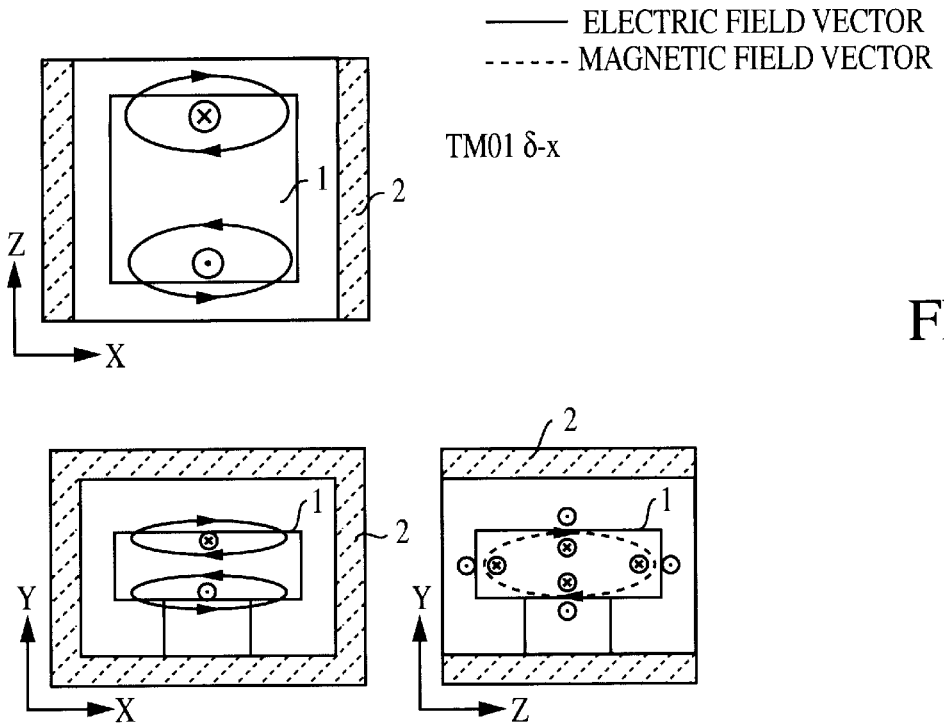
FIG. 31 consists of cross sections showing the electromagnetic field distributions in the respective modes of the above resonator device, respectively.
Figure 32:
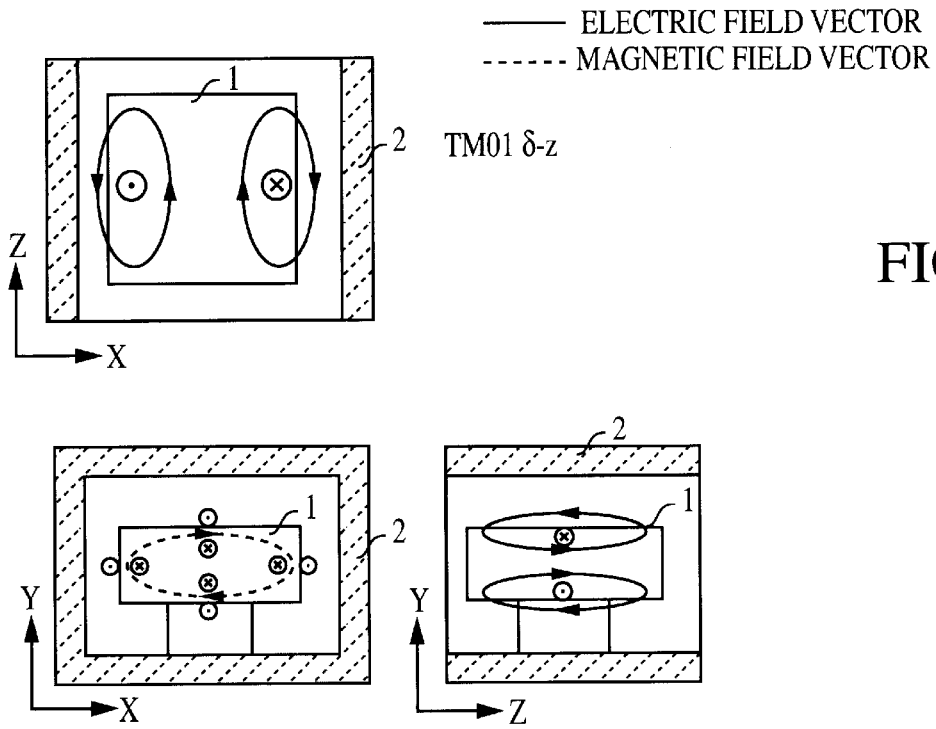
FIG. 32 consists of cross sections showing the electromagnetic field distributions in the respective modes of the above resonator device, respectively.

FIGS. 30 to 32 show the resonance, modes caused by the dielectric core 1 shown in FIG. 29. In these figures, x, y, and z represent the co-ordinate axes in the three dimensional directions shown in FIG. 29. FIGS. 30 to 32 show the cross sectional views of the two-dimensional planes, respectively. In FIGS. 30 to 32, a continuous line arrow indicates an electric field vector, a broken line arrow does a magnetic field vector, and symbols "•" and "×" do the directions of an electric field and a magnetic field, respectively. In FIGS. 30 to 32, shown are the TE01δ mode (TE01δ−y mode) in the y-direction, the TM01δ mode (TM01 δ−x) in the x-direction, and the TM01δ mode (TM01δ−z) in the z-direction.

Figure 33A:
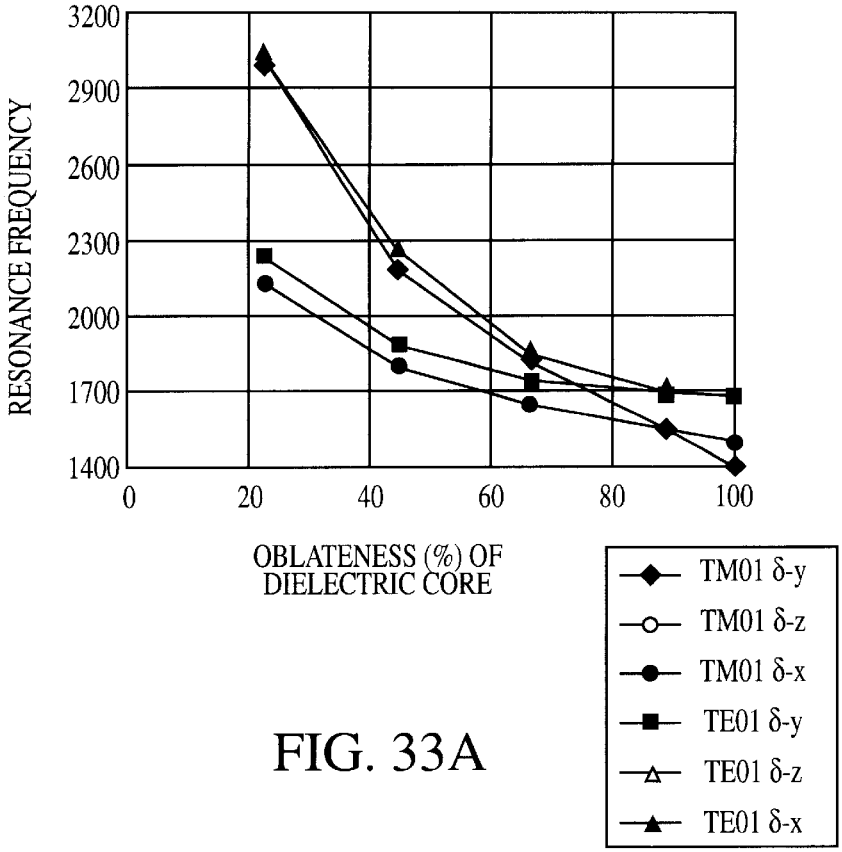
FIG. 33 consists of graphs showing the relations between the thickness of the dielectrics core of the above resonator device and the resonance frequencies in the respective modes.
Figure 33B:
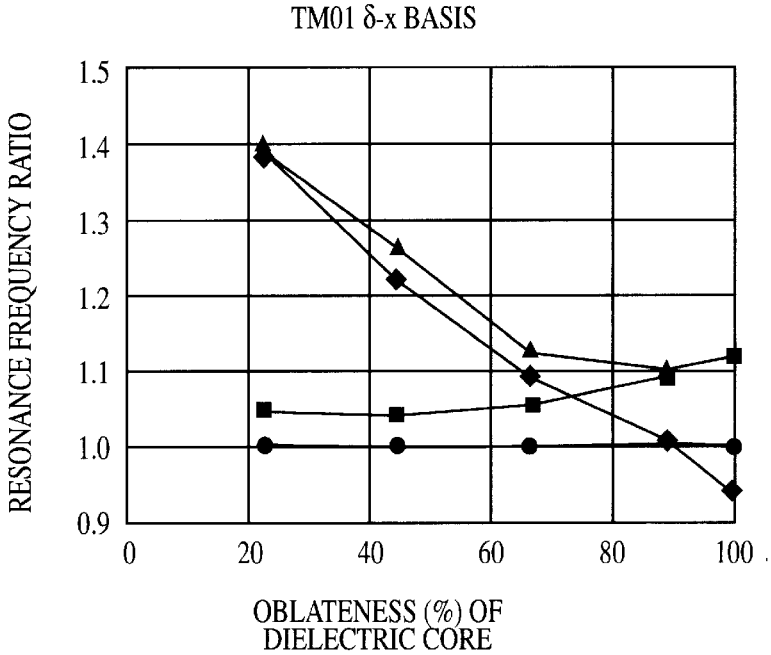

FIG. 33 shows the relation between the thickness of the dielectric core and the resonance frequencies in the six modes. In (A), the resonance frequency is plotted as ordinate. In (B), the resonance frequency ratio based on the TM01 δ−x mode is plotted as ordinate. In (A) and (B), the thickness of the dielectric core, expressed as oblateness, is plotted as abscissa. The TE01δ−z mode and the TE01δ−x mode are symmetric. A white triangle mark representing the TE01δ−z mode, and a black triangle mark for the TE01δ−x mode, overlap. Similarly, the TM01δ−z mode and the TM01δ−x mode are symmetric. Therefore, white circle marks representing the TE10δ−z mode, and black circle marks for the TM01 δ−x mode overlap.

Like this, as the thickness of the dielectric core is thinned (the oblateness is decreased), the resonance frequencies of the TE01δ−y mode, the TM01δ−x mode, and the TE01δ−z mode have a larger difference from those of the TM01δ−y mode, the TE01δ−x, and the TE01δ−z mode, respectively.

In this embodiment, the thickness of the dielectric core is set by utilization of the above described relation, and three modes, namely, the TE01δ−y, TM01δ−x, and TE01δ−z modes are used. The frequencies of the other modes, that is, the TM01 δ−y, TE01δ−x, and TE01δ−z modes are set to be further separated from those of the above-described three modes so as not to be affected by them.

Figure 34A:
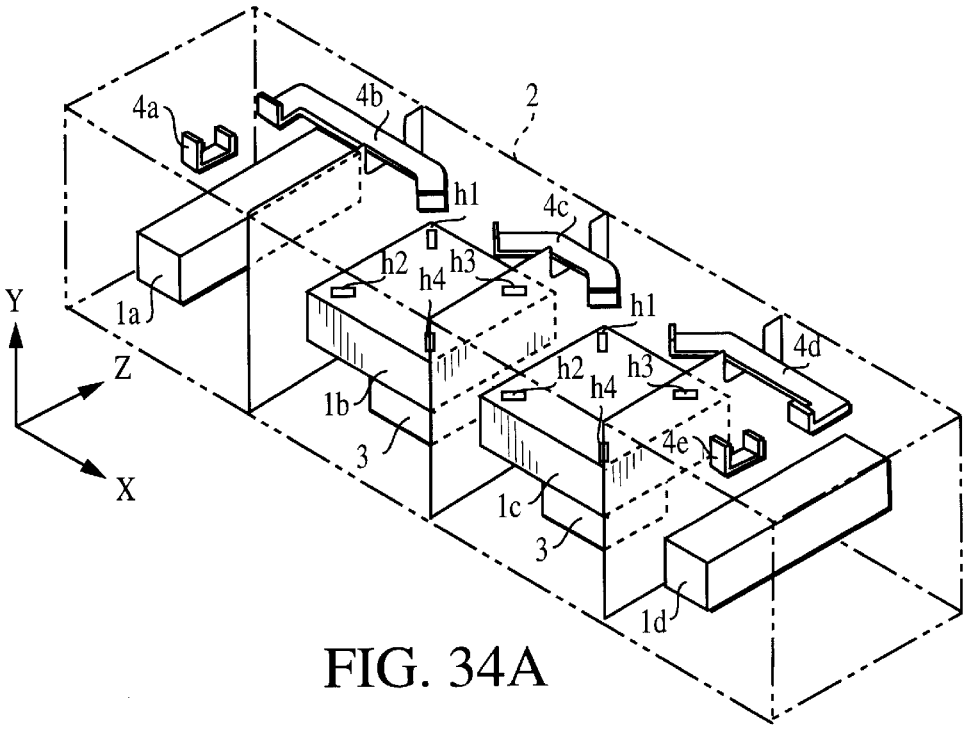
FIG. 34 illustrates the configuration of a dielectric filter.
Figure 34B:
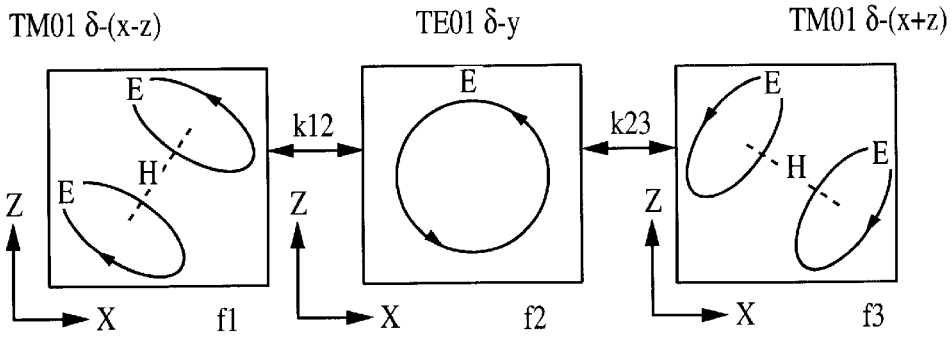
Figure 34C:
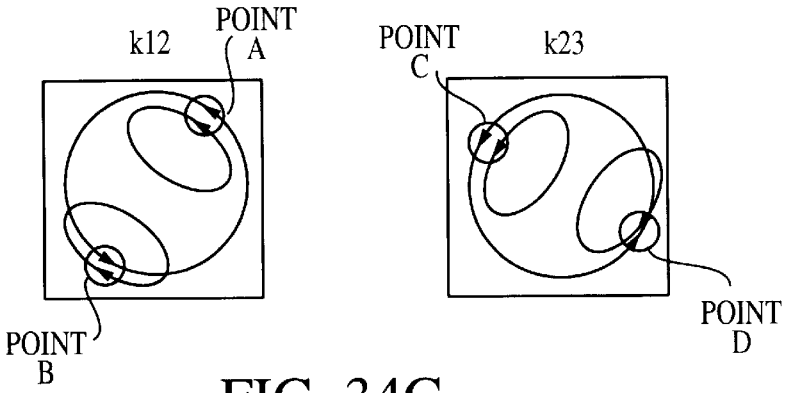

Next, an example of a dielectric filter including the above-described triplex mode dielectric resonator device will be described with reference to FIG. 34. In FIG. 34 (A), reference numerals 1*a*, 1*d* designate prism-shaped dielectric cores, and are used as a dielectric resonator in the TM110 mode. Reference numerals 1*b*, 1*c* designate square-sheet shaped dielectric cores in which two sides have substantially equal lengths, and the other one side is shorter than each of the two sides. The dielectric cores are supported at predetermined positions in a cavity 2 by means of supports 3, respectively. These dielectric cores are used as the above-described triple mode dielectric resonator. The triplex mode consists of three modes, that is, the TM01δ−(x−z) mode, the TE01δ−y mode, and the TM01 δ−(x+z) mode, as shown in (B).

For illustration of the inside of the cavity 2, the thickness of the cavity 2 is omitted, and only the inside thereof is shown by alternate long and two short dashes lines. Shielding plates are provided at the intermediate positions between adjacent dielectric cores, respectively.

Reference numerals 4*a* to 4*e* designate coupling loops, respectively, of which the coupling loops 4*b*, 4*c*, and 4*d* are arranged so as to extend over the above shielding plates, respectively. One end of the coupling loop 4*a* is connected to the cavity 2, and the other end is connected to the core conductor of a coaxial connector (not illustrated), for example. The coupling loop 4*a* is disposed in the direction where a magnetic field (line of magnetic force) of the TM 110 mode, caused by the dielectric core la, passes the loop plane of the coupling loop 4*a*, and thereby, the coupling loop 4*a* is magnetic field coupled to the TM110 mode generated by the dielectric core 1*a*. One end and its near portion of the coupling loop 4*b* are elongated in the direction where they are magnetic field coupled to the TM110 mode of the dielectric core 1*a*. The other end and its near portion are elongated in the direction where they are magnetic field coupled to the TM01δ−(x+z) mode of the dielectric core 1*c*. The both-ends of the coupling loop 4*b* are connected to the cavity 2. One end and its near portion of the coupling loop 4*c* are elongated in the direction where they are magnetic field coupled to the TM01δ−(x+z) mode of the dielectric core 1*b*. The other end is elongated in the direction where it is magnetic field coupled to the TM01δ−(x−z) mode of the dielectric core 1*b*. The both ends of the coupling loop 4*c* are connected to the cavity 2. Further, one end of the coupling loop 4*d* is elongated in the direction where it is magnetic field coupled to the TM01δ−(x+z) mode of the dielectric core 1*c*, and the other end is elongated in the direction that it is magnetic field coupled to the TM110 mode caused by the dielectric core 1*d*. The both ends of the coupling loop 4*d* are connected to the cavity 2. The coupling loop 4*e* is arranged in the direction where it is magnetic field coupled to She TM110 mode of the dielectric core 1*d*. One end of the coupling loop 4*e* is connected to the cavity 2, and the other end is connected to the core conductor of a coaxial connector (not illustrated).

Coupling-conditioning holes h1, h2, h3, and h4 are formed in the dielectric resonator in the triplex mode caused by the dielectric core 1*b*, and the dielectric resonator in the triple mode caused by the dielectric core 1*c*, respectively. For example, by setting the coupling-conditioning hole h2 to be larger than the hole h3, the balance between the electric field strengths at the point A and B shown in FIG. 34 (C) is broken, and thereby, energy is transferred from the TM01 δ−(x−z) mode to the TE01δ−y mode. By setting the coupling-conditioning hole h4 to be larger than the hole h1, the balance between electric field strengths at the point C and D shown in (C) is broken, and thereby, energy is transferred from the TE01δ−y mode to the TE01δ−(x+z) mode. Accordingly, the dielectric cores 1*b* and 1*c* constitute resonator circuits in which resonators in three stages are longitudinally connected, respectively. Accordingly, the dielectric filter, as a whole, operate as a dielectric filter composed of resonators in eight stages (1+3+3+1) longitudinally connected to each other.

Figure 35:
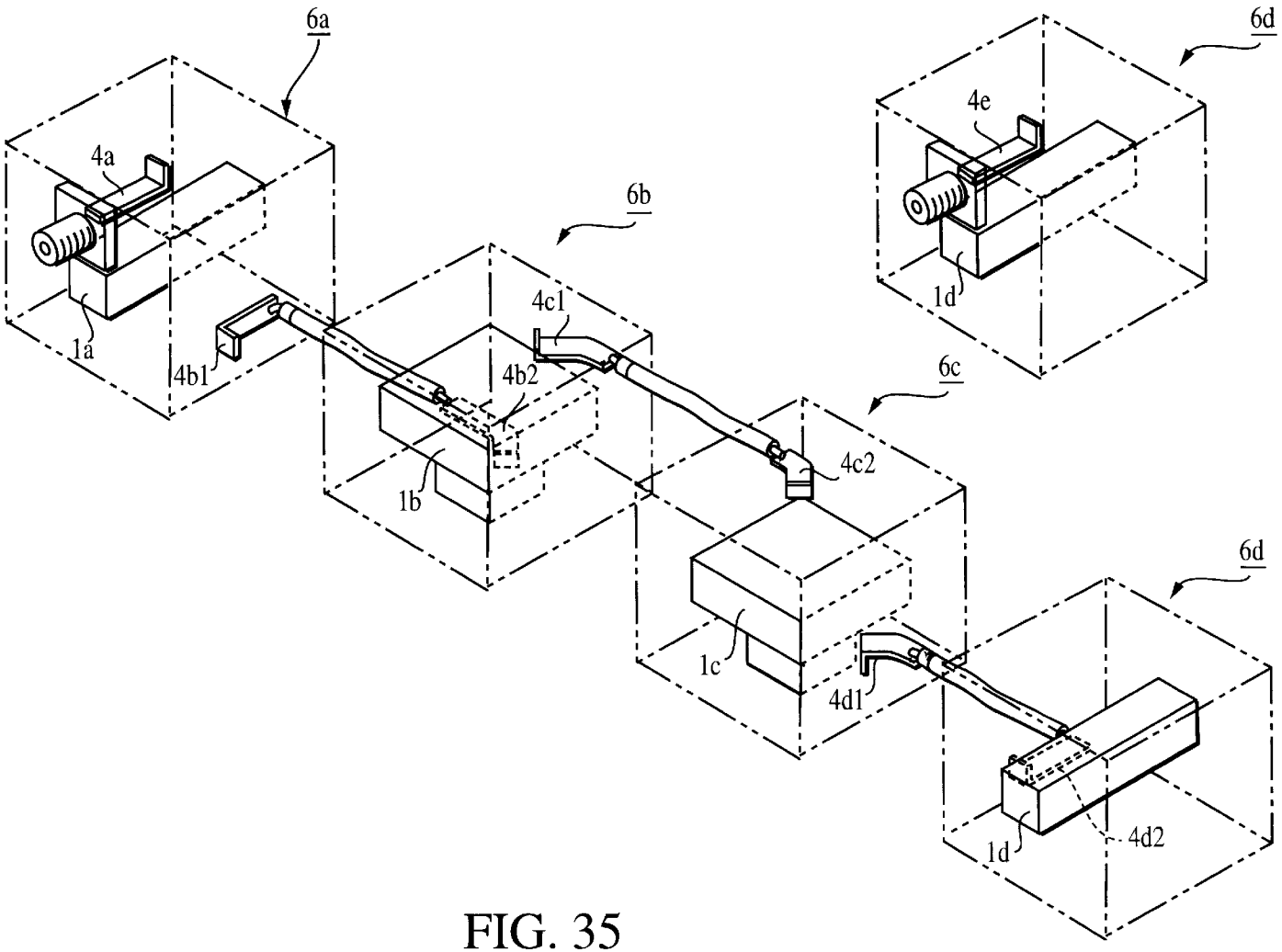
FIG. 35 illustrates the configuration of another dielectric filter.

Next, an example of another dielectric filter including the above-described triplex mode dielectric resonator device will be described with reference to FIG. 35. In the example shown in FIG. 34, the coupling loops, which are coupled to the respective resonance modes caused by adjacent dielectric cores, are provided. However, each dielectric resonator device may be provided for each dielectric core, independently. In FIG. 35, reference numerals 6*a*, 6*b*, 6*c*, and 6*d* designate dielectric resonator devices, respectively. These correspond to the resonators which are caused by the respective dielectric cores shown in FIG. 34 and are separated from each other. The dielectric resonator devices are arranged at positions as distant as possible so that two coupling loops provided for the respective dielectric resonator devices don't interfere with each other. Reference numerals 4*a*, 4*b*1, 4*b*2, 4*c*1, 4*c*2, 4*d*1, 4*d*2, and 4*e* designate respective coupling loops. One end of each of the coupling loops is grounded inside of the cavity, and the other end is connected to the core conductor of a coaxial cable by soldering or caulking. The outer conductor of the coaxial cable is connected to the cavity by soldering or the like. Regarding the dielectric resonator 6*d*, the figure showing the coupling loop 4*d*2 and the figure showing the coupling loop 4*e* are separately provided for simple illustration.

The coupling loops 4*a*, 4*b*1 are coupled to the dielectric core 1*a*, respectively. The coupling loop 4*b*2 is coupled to the TM01δ−(x−z) of the dielectric core 1*b*. The coupling loop 4*c*1 is coupled to the TM01 δ−(x+z) of the dielectric core 1*b*. Similarly, the coupling loop 4*c*2 is coupled to the TM01δ−(x−z) of the dielectric core 1*c*. The coupling loop 4*d*1 is coupled to the TM01δ−(x+z) of the dielectric core 1*c*. The coupling loop's 4*d*2 and 4*e* are coupled to the dielectric core 1*d*, respectively.

Accordingly, the coupling loops 4*b*1 and 4*b*2 are connected through a coaxial cable, the coupling loops 4*c*1 and 4*c*2 are connected through a coaxial cable, and further the coupling loops 4*d*1 and 4*d*2 are connected through a coaxial cable, and thereby, the whole of the dielectric resonator devices operates as a dielectric filter comprising the resonators in eight stages (1+3+3+1) longitudinally connected to each other, similarly to that shown in FIG. 34.

Figure 36:
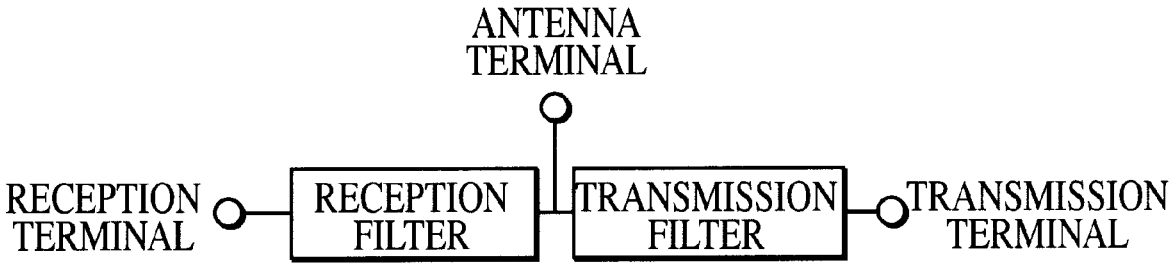
FIG. 36 illustrates the configuration of a transmission reception shearing device.

Next, an example of the configuration of a transmission-reception shearing device will be shown in FIG. 36. Hereupon, a transmission filter and a reception filter are band-pass filters each comprising the above dielectric filter. The transmission filter passes the frequency of a transmission signal, and the reception filter passes the frequency of a reception signal. The connection position between the output port of the transmission filter and the input port of the reception filter is such that it presents the relation that the electrical length between the connection point and the equivalent short-circuit plane of the resonator in the final stage of the transmission filter is odd-number times of the ¼ wave length at a reception signal frequency, and the electrical length between the above-described connection point and the equivalent short-circuit plane of the resonator in the first stage of the reception filter of the reception filter is odd-number times of the ¼ wavelength at a transmission signal frequency. Thereby, the transmission signal and the reception signal can be securely branched.

As seen in the above-description, similarly, by disposing plural dielectric filters between the port for use in common and the individual ports, a diplexer or a multiplexer can be formed.

Figure 37:
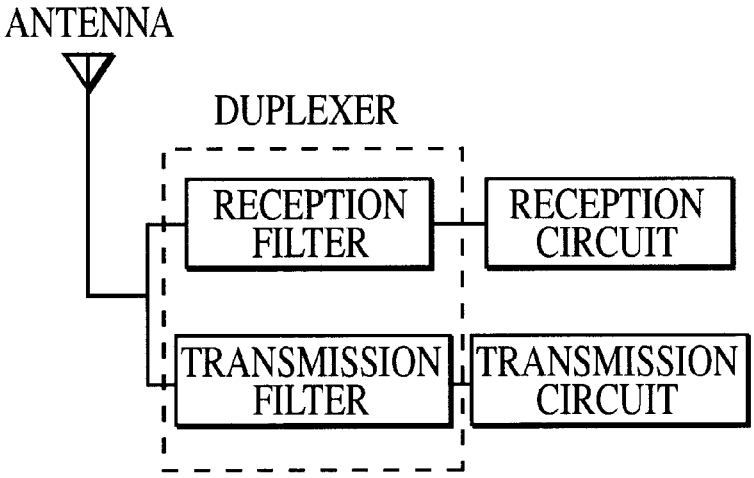
FIG. 37 illustrates the configuration of a communication device.

FIG. 37 is a block diagram showing the configuration of a communication device including the above-described transmission-reception shearing device (duplexer). The high frequency section of the communication device is formed by connecting a transmission circuit to the input port of a transmission filter, connecting a reception circuit to the output port of a reception filter, and connecting an antenna to the input-output port of the duplexer.

Further, a communication device small in size, having a high efficiency can be obtained as follows. Circuit component such as the diplexer, the multiplexer, the synthesizer, the distributor each described above, and the like are formed of the multimode dielectric resonator devices, and a communication device are formed of these circuit components.

As seen in the above-description; according to the present invention defined in claim 1, the supporting structure for the dielectric core is simplified. Further, since the dielectric core having a substantial parallelepiped-shape, operative to resonate in plural modes is used, plural resonators can be formed without plural dielectric cores being arranged, and a dielectric resonator device having stable characteristics can be formed.

According to the invention defined in claim 2, the concentration of an electromagnetic field energy onto a dielectric core is enhanced, the dielectric loss is reduced, and the $Q_0$ can be maintained at a high value.

According to the present invention defined in claim 3, supports as individually-separate parts become unnecessary. The positional accuracy of the supporting portions for the cavity and the dielectric core, and moreover, the positioning accuracy of the dielectric core into the cavity are enhanced. Thus, a multimode dielectric resonator device which is inexpensive and has stable characteristics can be obtained.

According to the invention defined in one of claims 4 and 5, the mechanical strength of a supporting portion per overall cross sectional area can be enhanced. Further, in the TM modes, the reduction of $Q_0$ in the mode in which the supporting portions or supports are elongated perpendicularly to the rotation plane of a magnetic field can be inhibited.

According to the present invention defined in claim 6, the reduction of $Q_0$ in a mode excluding the TM modes in which the supporting portions or supports are elongated perpendicularly to the rotation plane of a magnetic field can be inhibited.

According to the present invention defined in claim 7, by setting the drafting direction of a mold to be coincident with the axial direction of the angular pipe-shape, the cavity and the dielectric core can be molded integrally, easily by means of the mold having a simple structure.

According to the present invention defined in claim 8, a dielectric filter having a filter characteristic with a high Q and small in size can be obtained.

According to the present invention defined in claim 9, a composite dielectric filter small in size, having a low loss can be obtained.

According to the present invention defined in claim 10, a synthesizer small in size, having a low loss can be obtained.

According to the present invention defined in claim 6, the reduction of $Q_0$ in a mode excluding the TM modes in which the supporting portions or supports are elongated perpendicularly to the rotation plane of a magnetic field can be inhibited.

According to the present invention defined in claim 7, by setting the drafting direction of a mold to be coincident with the axial direction of the angular pipe-shape, the cavity and the dielectric core can be molded integrally, easily by means of the mold having a simple structure.

According to the present invention defined in claim 8, a dielectric filter having a filter characteristic with a high Q and small in size can be obtained.

According to the present invention defined in claim 9, a composite dielectric filter small in size, having a low loss can be obtained.

According to the present invention defined in claim 10, a synthesizer small in size, having a low loss can be obtained.

According to the present invention defined in claim 11, a distributor small in size, having a low loss can be obtained.

According to the present invention defined in claim 12 a communication device small in size, having a low loss can be obtained.

Industrial Applicability

As seen in the above-description, the multimode dielectric resonator device, the dielectric filter, the composite dielectric filter, the distributor, and the communication device including the same according to the present invention can be used in a wide variety of electronic apparatuses, for example, base stations in mobile communication.

What is claimed is:

1. A multimode dielectric resonator device comprising a dielectric core having a substantial parallelepiped-shaped, operative to resonate in plural modes, and supported substantially in the center of a cavity having a substantial parallelepiped-shape in the state that the dielectric core is separated from the inner walls of the cavity at predetermined intervals, respectively;

characterized in that the dielectric core is supported with respect to the respective inner walls of the cavity by a support having a lower dielectric constant than the dielectric core, wherein both the dielectric core and the support are made of a ceramic material.

2. A multimode dielectric resonator device according to claim 1, characterized in that the dielectric core is supported with respect to the respective inner walls of the cavity by a supporting portion molded integrally with the dielectric core or the cavity.

3. A multimode dielectric resonator device according to any one of claims 1 and 2, characterized in that the support or a supporting portion is provided in a ridge portion of the dielectric core or a portion along a ridge line of the dielectric core.

4. A multimode dielectric resonator device according to any one of claims 1 and 2, characterized in that the support or supporting portion is provided near to an apex of the dielectric core.

5. A multimode dielectric resonator device according to any one of claims 1 and 2, characterized in that the support or supporting portion is provided in the center of one face of the dielectric core.

6. A multimode dielectric resonator device according to claim 1, characterized in that a part of or the whole of the cavity comprises a molded product having an angular pipe-shape, and the dielectric core is supported with respect to the inner walls of the molded product by the support or supporting portion.

7. A dielectric filter comprising the multimode dielectric resonator device according to claim 1, and externally coupling means for externally coupling to a predetermined mode of the multimode dielectric resonator device.

8. A composite dielectric filter comprising the dielectric filter according to claims 7 provided between a single or plural ports to be used in common and plural ports to be used individually.

9. A synthesizer comprising the multimode dielectric resonator device according to claim 1, independently, externally coupling means for externally coupling to plural predetermined modes of the multimode dielectric resonator device, respectively, independently, and commonly externally coupling means for externally coupling to plural predetermined modes of the multimode dielectric resonator device in common, wherein the commonly externally coupling means is an output port, and the plural independently externally coupling means are input ports.

10. A distributor comprising the multimode dielectric resonator device according to claim 1, independently, externally coupling means for externally coupling to plural predetermined modes of the multimode dielectric resonator device, independently, and commonly externally coupling means for externally coupling to plural predetermined modes of the multimode dielectric resonator device in common, wherein the commonly externally coupling means is an input port, and the plural independently externally coupling means are output ports.

11. A communicating device comprising;

a high-frequency circuit selected from the group consisting of a transmission circuit and reception circuit; and connected to said high-frequency circuit, the composite dielectric filter according to claim 8.

12. A synthesizer comprising the multimode dielectric resonator device according to claim 1, a plurality of input ports which independently provide external coupling to respective predetermined modes of the multimode dielectric resonator device, and a common output port which provides external coupling to plural predetermined modes of the multimode dielectric resonator device.

13. A distributor comprising the multimode dielectric resonator device according to claim 1, a common input port which provides external coupling to plural predetermined modes of the multimode dielectric resonator device, and a plurality of output ports which independently provide external coupling to respective predetermined modes of the multimode dielectric resonator device.

14. A communication device comprising:

the synthesizer according to claim 9 or claim 12;

a first high-frequency circuit connected to one of said input ports; and a second high-frequency circuit connected to another one of said input ports.

15. A communication device comprising:

the distributor according to claim 10 or claim 13;

a first high-frequency circuit connected to one of said output ports; and a second high-frequency circuit connected to another one of said output ports.

* * * * *